US011291245B2

(12) United States Patent
Bernhard et al.

(10) Patent No.: US 11,291,245 B2
(45) Date of Patent: Apr. 5, 2022

(54) CONTAINER WITH REMOVABLE CLEANING TOOL

(71) Applicant: Philip Morris Products S.A., Neuchatel (CH)

(72) Inventors: Philipp Bernhard, Biel/Bienne (CH); Onur Dayioglu, Neuchatel (CH); Kilian Augusto Iannucci, Biel/Bienne (CH); Katja Sylvia Leu-Buerki, Biel/Bienne (CH); Samuel Malzach, Biel/Bienne (CH); Aymeric David Niederhauser, Biel/Bienne (CH); Martin Sigrist, Biel/Bienne (CH); Mario Tronza, Biel/Bienne (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 16/771,476

(22) PCT Filed: Nov. 28, 2018

(86) PCT No.: PCT/EP2018/082907
§ 371 (c)(1),
(2) Date: Jun. 10, 2020

(87) PCT Pub. No.: WO2019/115235
PCT Pub. Date: Jun. 20, 2019

(65) Prior Publication Data

US 2021/0171273 A1 Jun. 10, 2021

(30) Foreign Application Priority Data

Dec. 13, 2017 (EP) ..... 17207130

(51) Int. Cl.
*A24F 15/00* (2020.01)
*A24F 15/18* (2006.01)
(Continued)

(52) U.S. Cl.
CPC ..... *A24F 15/18* (2013.01); *A24F 15/01* (2020.01); *A24F 40/85* (2020.01); *B08B 1/005* (2013.01);
(Continued)

(58) Field of Classification Search
CPC ..... A24F 15/18; A24F 40/85; A24F 15/01; A24F 15/08; B65D 85/1045; B65D 85/1081
(Continued)

(56) References Cited

U.S. PATENT DOCUMENTS 3,404,770 A * 10/1968 Peery ..... B65D 85/1045 206/246
5,160,024 A * 11/1992 Evers ..... B65D 85/1045 206/268
(Continued)

FOREIGN PATENT DOCUMENTS

DE 8801301 U1 6/1988
DE 20 2017 104 228 U1 8/2017
(Continued)

OTHER PUBLICATIONS

International Search Report and Written Opinion dated Mar. 19, 2019 in PCT/EP2018/082907 filed Nov. 28, 2018.
(Continued)

*Primary Examiner* — Steven A. Reynolds
(74) *Attorney, Agent, or Firm* — Oblon, McClelland, Maier & Neustadt, L.L.P.

(57) ABSTRACT

A container for aerosol-generating articles is provided, including: a box portion formed from a single laminar blank; a lid portion formed from a same single laminar blank as the box portion; a plurality of aerosol-generating articles disposed within the box portion; and a removable laminar blank made from a same material as the single laminar blank, the
(Continued)

removable laminar blank being disposed within and attached to the lid portion, the removable laminar blank including at least one longitudinal line of weakness, and the removable laminar blank being foldable along the at least one longitudinal line of weakness to form an elongate cleaning tool having a scraping surface at a distal end thereof.

14 Claims, 13 Drawing Sheets

(51) Int. Cl.

| | |
|---|---|
| ***B65D 85/10*** | (2006.01) |
| ***A24F 40/85*** | (2020.01) |
| ***A24F 15/01*** | (2020.01) |
| ***B08B 1/00*** | (2006.01) |
| *A24F 40/46* | (2020.01) |

(52) U.S. Cl.
CPC ..... *B65D 85/1045* (2013.01); *B65D 85/1081* (2013.01); *A24F 40/46* (2020.01)

(58) Field of Classification Search
USPC ..... 206/831, 236
See application file for complete search history.

(56) References Cited

U.S. PATENT DOCUMENTS

| | | | | |
|---|---|---|---|---|
| 5,363,955 | A * | 11/1994 | Fleenor | B65D 5/422 206/273 |
| 5,558,217 | A * | 9/1996 | Focke | B65D 85/1045 206/268 |
| 6,401,918 | B1 | 6/2002 | Focke et al. | |
| 6,450,329 | B1 * | 9/2002 | Draghetti | B31F 1/247 206/252 |
| 6,513,651 | B1 * | 2/2003 | Focke | B65D 85/1081 206/268 |
| 7,954,635 | B2 * | 6/2011 | Biondi | B65D 85/1009 206/252 |
| 2003/0010656 | A1 | 1/2003 | Focke et al. | |
| 2006/0051457 | A1 * | 3/2006 | Bougoulas | B65D 83/0472 426/5 |
| 2011/0155796 | A1 | 6/2011 | Moore et al. | |
| 2015/0320111 | A1 * | 11/2015 | Slooff | B65D 85/10568 206/242 |
| 2017/0203911 | A1 | 7/2017 | Slooff | |

FOREIGN PATENT DOCUMENTS

| | | | |
|---|---|---|---|
| EP | 2 789 547 | A1 | 10/2014 |
| RU | 2004 100 822 | A | 2/2005 |
| RU | 2 294 308 | C2 | 2/2007 |
| RU | 2 340 525 | C1 | 12/2008 |
| RU | 2 455 214 | C2 | 7/2012 |
| WO | WO 2010/001335 | A1 | 1/2010 |
| WO | WO 2013/102614 | A2 | 7/2013 |

OTHER PUBLICATIONS

Combined Russian Notice of Allowance and Research dated Dec. 6, 2021 in corresponding Russian Patent Application No. 20202122684 (with English translation), 16 pages.

* cited by examiner

CONTAINER WITH REMOVABLE CLEANING TOOL

The present invention relates to a container for aerosol-generating articles. In particular, the invention relates to containers comprising a box portion with a plurality of aerosol-generating articles, a lid portion, and an elongate cleaning tool.

Aerosol-generating articles in which an aerosol-forming substrate for generating an inhalable aerosol is heated, rather than combusted, are known in the art. The aim of such heated aerosol-generating articles is to reduce known harmful smoke constituents produced by the combustion and pyrolytic degradation of tobacco in conventional cigarettes. Typically in such heated aerosol-generating articles, an aerosol is generated by the transfer of heat from a heat source to a physically separate aerosol-forming substrate or material, which may be located within, around or downstream of the heat source. During smoking, volatile compounds are released from the aerosol-forming substrate by heat transfer from the heat source and entrained in air drawn through the smoking article. As the released compounds cool, they condense to form an aerosol that is inhaled by the consumer. Such aerosol-generating articles are typically provided in a container of aerosol-generating articles, much like a cigarette container or pack.

WO2013102614 discloses an example of an electrically operated aerosol-generating device in which an aerosol-forming substrate of an aerosol-generating article is heated in direct contact with a heating element to form an inhalable aerosol. In such a device configuration, heat from a heating element may be conveyed almost instantaneously to at least a portion of the aerosol-forming substrate when the heating element is actuated, and this may facilitate the rapid generation of an aerosol. Furthermore, the overall heating energy required to generate an aerosol may be lower than would be the case in a system where the aerosol-forming substrate does not directly contact a heating element and initial heating of the substrate occurs by convection or radiation. Where a heating element is in direct contact with an aerosol-forming substrate, the initial heating of portions of the substrate that are in contact with the heating element will be effected by conduction.

When an aerosol-forming substrate, such as a tobacco substrate, is heated, volatile compounds are released. Volatile compounds and aerosol evolved by the heat from the heating element may become deposited on the aerosol-generating device and in particular on a surface of the heating element. Particles of the aerosol-forming substrate itself may also become adhered to the heating element, particularly if the heating element is in direct contact with the aerosol-forming substrate. For example, when using the device described in WO2013102614, a heating blade warms a tobacco substrate to temperatures in excess of 200° C., releasing volatile compounds, nicotine and glycerol, all of which form a respiratory aerosol for inhalation by the consumer. However, residues and dust tend to collect inside the cavity in the device after smoking multiple aerosol-generating articles.

Particles and compounds adhered to and deposited on the heating element or in the cavity of an aerosol-generating device may prevent the heating element from functioning in an optimal manner. These particles and compounds may also break down during use of the aerosol-generating device and impart unpleasant or bitter flavours to a user. For these reasons it is desirable to clean the heating element and the cavity in which the heating element is located periodically.

Cleaning may be effected by a pyrolysis method, in which the heating element is heated to a temperature sufficiently high to burn any residues or deposits. Pyrolysis on its own may not always be effective, however. A cleaning consumable, such as a brush, may be used as an alternative to, or in addition to, pyrolysis. However, such cleaning consumables must be carried around by the user in addition to the aerosol-generating device and the container of aerosol-generating articles. As a result, the cleaning consumable may be forgotten or viewed as an inconvenience, particularly if the cleaning consumable is cumbersome. This may lead to infrequent cleaning of the heating element or the cavity and reduced performance.

According to a first aspect of the present invention, there is provided a container for aerosol-generating articles, the container comprising: a box portion; a lid portion; a plurality of aerosol-generating articles positioned within the box portion; and a removable laminar blank positioned in the box portion, or the lid portion, or both, wherein the removable laminar blank comprises at least one longitudinal line of weakness, the removable laminar blank being foldable along the at least one longitudinal line of weakness to form an elongate cleaning tool having a distal end with a diameter of less than or equal to the diameter of at least one of the aerosol-generating articles and having a scraping surface at the distal end.

According to a second aspect of the present invention, there is provided a container for aerosol-generating articles, the container comprising: a box portion formed from a single laminar blank; a lid portion formed from the same single laminar blank as the box portion; a plurality of aerosol-generating articles positioned within the box portion; and a removable laminar blank made from the same material as the single laminar blank, the removable laminar blank being positioned within and attached to the lid portion, wherein the removable laminar blank comprises at least one longitudinal line of weakness, the removable laminar blank being foldable along the at least one longitudinal line of weakness to form an elongate cleaning tool having a scraping surface at its distal end.

In the second aspect of the present invention, the cleaning tool may have a distal end with a diameter of less than or equal to the diameter of at least one of the aerosol-generating articles. By configuring the removable laminar blank such that the resulting elongate cleaning tool has a distal end with a diameter of less than or equal to the diameter of at least one of the aerosol-generating articles, the distal end may be inserted into the cavity of an aerosol-generating device in which the aerosol-generating articles are individually received in use. The scraping surface allows for mechanical cleaning of surfaces within the cavity of the aerosol-generating device, and of an internal heating element positioned within such a cavity.

In the present invention, the elongate cleaning tool is provided within the container, and so does not need to be carried separately to the container of aerosol-generating articles. This facilitates frequent cleaning of the aerosol-generating device to maintain proper performance, since it allows the user to keep the cleaning tool with the aerosol-generating articles where it may be more conveniently located and used more often. Furthermore, by providing the elongate cleaning tool in the form of a removable laminar blank, the cleaning tool may be provided within the container without occupying space required by the aerosol-generating articles, meaning that the capacity and dimensions of such containers may be the same as for conventional containers. Once the aerosol-generating articles in the container have been consumed, the container and the elongate cleaning tool may be disposed of together, since a new cleaning tool can be provided with the new container. This allows the cleaning tool to be designed with a design life corresponding only to the number of aerosol-generating articles in the container. Thus, the cleaning tool may be lightweight and cheap to manufacture.

The removable laminar blank may be positioned within the lid portion, or the box portion, or both. The removable laminar blank may be loose in the lid portion of the container or the box portion of the container, or in both the lid portion and the box portion. For example, the removable laminar blank may extend from the box portion into the lid portion when the lid portion is closed. The removable laminar blank may be attached to the lid portion. The removable laminar blank may be attached to the box portion. The removable laminar blank may be attached to the lid portion and the box portion.

In preferred embodiments, the removable laminar blank is positioned within and attached to the lid portion. By attaching the removable blank to the lid portion of the container, the cleaning tool is easily accessed and visible to the consumer when the container is opened. This may further encourage use of the cleaning tool and frequent cleaning of the aerosol-generating device. Attaching the removable laminar blank to the lid portion may help to avoid unintentional loss or dislodgement of the removable laminar blank prior to use, for example during transit.

The removable laminar blank may be formed from a different material to the box portion or the lid portion, or both. In preferred embodiments, the removable laminar blank is made from the same material as one or both of the lid portion and the box portion. This is particularly preferred when the box portion and the lid portion are formed from a single laminar blank. This may help to improve the ease of manufacture of the container.

In some embodiments, the container may be a slide and shell type container. In some preferred embodiments, the container is a hinge lid container in which the box portion and the lid portion are formed from a single laminar blank. In such embodiments, the removable laminar blank may be made from the same material as the single laminar blank.

The removable laminar blank may be a discrete component within the container.

Advantageously, the box portion and the lid portion are both formed from a single laminar blank, and the removable laminar blank is made from the same material as the single laminar blank and is integral with the single laminar blank. Advantageously, the removable laminar blank is attached to the single laminar blank by a line of weakness. By having an integral removable laminar blank, the elongate cleaning tool is easily incorporated into the package. The removable laminar blank can also be manufactured quickly and at low cost.

The removable laminar blank may be attached to the single laminar blank along a front wall of the box portion.

Advantageously, the lid portion comprises: a lid portion back wall depending from a box portion back wall; a lid portion top wall depending from the lid portion back wall; and a lid portion front wall depending from the lid portion top wall, wherein the lid portion front wall comprises a lid portion front panel depending from the lid portion top wall, and a lid portion front wall under panel depending from the lid portion front panel, wherein the lid portion front wall under panel underlies the lid portion front panel. Advantageously, the removable laminar blank is at least partially defined by the lid portion front wall under panel. The removable laminar blank may be entire defined by the lid portion front wall under panel.

The lid portion front wall under panel may depend from the lid portion front wall along a line of weakness to allow the lid portion front wall under panel to be removed easily from the lid portion front wall. A line of weakness may be provided across the lid portion front wall under panel to allow part of the lid portion front wall under panel to be removed easily. In such embodiments, a portion of the lid portion front wall under panel will remain attached to the lid portion front wall after the lid portion front wall under panel has been divided along the line of weakness. The portion of the lid portion front wall under panel which is separable along the line of weakness then defines at least part of the removable laminar blank.

The removable laminar blank may be defined entirely by the lid portion front wall under panel. In some embodiments, the lid portion further comprises an additional lid portion under panel depending from the lid portion front wall under panel, wherein the removable laminar blank is at least partially defined by the additional lid portion under panel. The removable laminar blank may be defined by both the lid portion front wall under panel and the additional lid portion under panel. The additional lid portion under panel may be hinged from the lid portion front wall under panel. The additional lid portion under panel may be adhered to an inner surface of the lid portion. The lid portion top wall may comprise a lid portion top panel and the additional lid portion under panel, wherein the additional lid portion under panel underlies the lid portion top panel.

The removable laminar blank comprises at least one longitudinal line of weakness along which the removable laminar blank is foldable to form the elongate cleaning tool.

The at least one longitudinal line of weakness may be configured so that the elongate cleaning tool has substantially parallel longitudinal sides. In this configuration, the diameter of the elongate cleaning tool may be substantially the same at its proximal and distal ends.

Advantageously, the at least one longitudinal line of weakness or the longitudinal side edges of the removable laminar blank, or both the at least one longitudinal line of weakness and the longitudinal side edges of the removable laminar blank, are non-parallel to the longitudinal axis of the removable laminar blank such that, when the removable laminar blank is folded along the at least one longitudinal line of weakness to form the elongate cleaning tool, the elongate cleaning tool tapers towards the scraping surface. That is, the elongate cleaning tool narrows towards the scraping surface at the distal end.

By having a cleaning tool which tapers towards the scraping surface, easy insertion of the cleaning tool into a cavity in the device is facilitated. The taper may also increase the effectiveness of the cleaning tool and may allow the rigidity of the elongate cleaning tool to be increased away from the cleaning surface in a region where the diameter may be larger.

The at least one longitudinal line of weakness may comprise a single longitudinal line of weakness. The at least one longitudinal line of weakness may comprise a plurality of longitudinal lines of weakness.

The at least one longitudinal line of weakness may extend along only part of the length of the removable laminar blank. The at least one longitudinal line of weakness may extend along substantially the entire length of the removable laminar blank.

The at least one longitudinal line of weakness may be positioned on the removable laminar blank such that the elongate cleaning tool has an open cross-sectional shape. For example, the elongate cleaning tool may have a V-shaped or C-shaped cross section.

Advantageously, the at least one longitudinal line of weakness comprises a plurality of longitudinal lines of weakness each extending along substantially the entire length of the removable laminar blank and positioned such that, when the removable laminar blank is folded along the plurality of longitudinal lines of weakness to form the elongate cleaning tool, the elongate cleaning tool has a closed cross-sectional shape.

By having a cleaning tool with a closed cross-sectional shape, the rigidity of the cleaning tool may be increased. This may increase the longevity of the cleaning tool and may increase its effectiveness in cleaning debris which is firmly adhered.

The elongate cleaning tool may have any suitable closed cross-sectional shape. For example, the tool may have an irregular closed cross-sectional shape. In some examples, the tool may have a regular polygonal cross-sectional shape, such as a square, pentagonal, or hexagonal cross-sectional shape.

Advantageously, the plurality of longitudinal lines of weakness are positioned such that, when the removable laminar blank is folded along the plurality of longitudinal lines of weakness to form the elongate cleaning tool, the elongate cleaning tool has a triangular cross-sectional shape.

The plurality of longitudinal lines of weakness may be positioned such that the longitudinal side edges of the removable laminar blank are directly adjacent to each other when the removable laminar blank is folded along the plurality of longitudinal lines of weakness to form the elongate cleaning tool. That is, when the removable laminar blank is folded along the plurality of longitudinal lines of weakness, to form the elongate cleaning tool a first longitudinal edge of the removable laminar blank abuts a second, opposite longitudinal edge.

Advantageously, the plurality of longitudinal lines of weakness are positioned such that the longitudinal side edges of the removable laminar blank overlap with each other when the removable laminar blank is folded along the plurality of longitudinal lines of weakness to form the elongate cleaning tool.

By having a cleaning tool with a closed cross-sectional shape and with longitudinal side edges which overlap, rigidity may be further increased.

Where the elongate cleaning tool has a closed cross-sectional shape, the removable laminar blank forms the walls of the elongate cleaning tool and defines a central lumen, or passage, around which the walls of the elongate cleaning tool are provided.

The central lumen may be substantially unobstructed. Alternatively, the removable laminar blank may be configured such that the elongate cleaning tool comprises one or more internal projections extending transversely into the central lumen. This may facilitate cleaning of an internal heating element, such as a heating blade, for example by positioning the elongate cleaning tool around the internal heating element and mechanically cleaning the heating element with the one or more internal projections.

Advantageously, the removable laminar blank further comprises at least one additional longitudinal line of weakness positioned such that, when the removable laminar blank is folded along the plurality of longitudinal lines of weakness in a first direction and is folded along the at least one additional longitudinal line of weakness in a second, opposite direction to form the elongate cleaning tool, the elongate cleaning tool comprises an internal projection extending into a central lumen of the elongate cleaning tool, wherein the at least one additional longitudinal line of weakness forms at least one vertex of the internal projection.

The at least one additional longitudinal line of weakness may consist of a single additional longitudinal line of weakness. In such embodiments, the additional longitudinal line of weakness forms an apex of the internal projection.

The at least one additional longitudinal line of weakness may comprise a plurality of additional longitudinal lines of weakness. In such embodiments, the additional longitudinal line of weakness forms a plurality of vertices of the internal projection.

The internal projection may have any suitable cross-sectional shape, such as a triangular cross-sectional shape, a square cross-sectional shape, a rectangular cross-sectional shape, a trapezoidal cross-sectional shape, or any other polygonal cross-sectional shape. The internal projection may be formed from two adjacent panels of the removable blank which are folded along a single additional longitudinal line of weakness. The two adjacent panels may be folded against each other. In such embodiments, the internal projection may have a substantially planar cross-section.

The internal projection may extend into the central lumen of the elongate cleaning tool along only part of the length of the elongate cleaning tool. The internal projection may extend into the central lumen of the elongate cleaning tool along substantially the entire length of the elongate cleaning tool. The internal projection may have a width of from about 1.5 millimetres to about 4 millimetres, for example from about 1.8 millimetres to about 3.3 millimetres. The width of the internal projection is the maximum transverse dimension of the internal projection. That is, the degree to which the internal projection extends into the central lumen when viewed as a transverse cross-section.

In use, the elongate cleaning tool may be grasped simply on its outer surface.

Advantageously, the removable laminar blank further comprises at least one proximal line of weakness at or adjacent to the proximal end of the removable laminar blank and extending along only part of the length of the removable laminar blank. The removable laminar blank may be foldable along the at least one proximal line of weakness to form a handle portion extending outwardly from the elongate cleaning tool at or adjacent to the proximal end of the elongate cleaning tool. The handle portion may facilitate grasping of the cleaning tool.

As used herein, the term "line of weakness" is used to describe a portion of a surface of a container or a blank wherein the structural strength of the material has been weakened by any suitable technique. For example, a line of weakness may be formed as a scoring line, a creasing line, an ablation line, or a perforated line.

Advantageously, the at least one longitudinal line of weakness, along which the removable laminar blank is foldable to form the elongate cleaning tool, is formed by creasing, scoring, or by ablation, or a combination thereof. In preferred embodiments, the at least one longitudinal line of weakness is formed by creasing. Where the box portion and the lid portion are both formed from a single laminar blank and the removable laminar blank is made from the same material as the single laminar blank and is integral with the single laminar blank, the at least one longitudinal line of weakness is advantageously formed in the same manner as the fold lines in the single laminar blank which are used to form the box portion and the lid portion. For example, where the box portion and the lid portion are formed from a single laminar blank comprising a plurality of fold lines formed by creasing, the at least one longitudinal line of weakness in the removable laminar blank is also formed by creasing. The single laminar blank may comprise a plurality of fold lines by which the box and lid portions are formed, wherein any lines of weakness in the removable laminar blank are formed in the same manner as the fold lines, for example, by creasing. Where the removable laminar blank comprises a plurality of lines of weakness, the plurality of lines of weakness may each be formed in the same manner as each other. The plurality of lines of weakness may each be formed in the same manner as the fold lines in the single laminar blank used to form the box and lid portions of the container.

Advantageously, where the box portion and the lid portion are both formed from a single laminar blank, the removable laminar blank is made from the same material as the single laminar blank, is integral with the single laminar blank and is attached to the single laminar blank by a line of weakness, the line of weakness, is formed by scoring, or by ablation, or by a perforated line, or any combination thereof.

As used herein, the term "scoring line" refers to a line formed by partially cutting into the material of the blank. A scoring line may be formed by removing material from the blank, that is, by forming a groove or trough in the blank. As an alternative, a scoring line may be formed without removing any material from the blank. This would typically involve compression of material.

The term "creasing line" typically refers to a line formed by displacing a portion of the material substantially perpendicular to the plane of the blank, which results in the formation of a groove or trough in the blank. The displacement may involve compression and is typically achieved by means of a compression tool, such as a roller. Alternatively, or in addition, the material in the creasing line may be displaced so as to at least partially protrude from the opposite side of the blank. Generally, no material is removed when a creasing line is formed.

The term "ablation line" is used instead to describe a line formed by removing material from a surface of the blank to a predetermined depth by way of ablation, such as by means of a laser beam or a blade.

The term "perforated line" describes a line or sequence of discrete holes or slots formed in the blank. The holes may be formed by pushing an object through the blank, which may result in material being removed from the blank, for example by punching. Alternatively, the holes may be created without effectively removing material, the object being used to push material outwardly from a centre of the hole.

The scraping surface of the elongate cleaning tool may be a flat or curved surface at the distal end of the elongate cleaning tool. The scraping surface of the elongate cleaning tool may be a sharp tip formed by the convergence of two edges of the elongate cleaning tool.

Advantageously, the removable laminar blank may comprise a plurality of discrete fingers at its distal end, each of the discrete fingers being foldable along a transverse fold line to form inwardly extending bristles defining the scraping surface at the distal end of the elongate cleaning tool.

With this arrangement, cleaning of an internal heating element may be facilitated. This is because the bristles are pointed towards the internal heating element during cleaning and may allow for a greater scraping force to be applied to the heating element in a transverse direction when compared to a scraping surface formed by the distal edge of a cleaning tool. The bristles may also increase the surface area of the scraping surface to allow the cavity and the heating element to be cleaned more quickly, for example simply by moving the tool up and down within the cavity, or rotating the tool within the cavity.

According to a third aspect of the present invention, there is provided a container for aerosol-generating articles, the container comprising: a box portion; a lid portion; a plurality of aerosol-generating articles positioned within the box portion; and a removable laminar blank positioned in the box portion, or the lid portion, or both, wherein the removable laminar blank is bendable about its longitudinal axis to form a tubular elongate cleaning tool having a distal end with a diameter of less than or equal to the diameter of at least one of the aerosol-generating articles, and wherein the removable laminar blank comprises a plurality of discrete fingers at its distal end, each of the discrete fingers being foldable along a transverse fold line to form inwardly extending bristles defining a scraping surface at the distal end of the elongate cleaning tool.

The removable laminar blank may be planar. The removable laminar blank may have any suitable shape. For example, the removable laminar blank may have a triangular, square, rectangular, lozenge, oval, trapezoidal, diamond, pentagonal, hexagonal, heptagonal, or other polygonal shape.

The removable laminar blank may be formed from any suitable material or combination of materials, including, but not limited to, cardboard, paperboard, plastic, metal, or combinations thereof. Preferably, the removable laminar blank is a cardboard blank having a weight of between about 100 grams per square metre and about 350 grams per square metre. In preferred embodiments, the blank has a thickness of from about 100 micrometres to about 500 micrometres, preferably from about 200 micrometres to about 350 micrometres. Preferably, removable laminar blanks according to the invention, and the resulting elongate cleaning tools, have a length of between about 60 millimetres and about 150 millimetres, more preferably a length of between about 70 millimetres and about 125 millimetres, wherein the length is measured from the distal edge to the proximal edge of the removable laminar blank. In certain embodiments, the removable laminar blank has a length of from about 70 millimetres to about 75 millimetres, for example about 72 millimetres. The length of the removable blank may substantially correspond to the width of the container.

According to a further aspect, there is provided a laminar blank for forming a container for aerosol-generating articles according to any of the embodiments described herein.

Also provided is a laminar blank for forming a container for aerosol-generating articles, the blank comprising: a box-defining blank portion for forming a box portion of the container; a lid-defining blank portion for forming a lid portion of the container, and a removable laminar blank portion for forming a removable laminar blank, wherein the removable laminar blank comprises at least one longitudinal line of weakness along which the removable laminar blank is foldable or bendable to form an elongate cleaning tool having a scraping surface at its distal end. The removable laminar blank portion may be attached to the box-defining blank portion or the lid-defining blank portion by a line of weakness. The removable laminar blank portion may comprise a plurality of discrete fingers at its distal end, each of the discrete fingers being foldable along a transverse fold line to form inwardly extending bristles defining a scraping surface at the distal end of the elongate cleaning tool.

The box-defining blank portion may comprise a box portion back panel for forming a box portion back wall of the container, with the lid-defining blank portion depending from the box-defining blank portion along a lid hinge line extending across the box portion back panel.

The lid-defining blank portion may comprise: a lid portion back panel depending from the box portion back panel; a lid portion top panel depending from the lid portion back panel; a lid portion front panel depending from the lid portion top panel, and a lid portion front under panel depending from the lid portion front panel, wherein the removable laminar blank is at least partially defined by the lid portion front under panel. In such embodiments, the lid portion front under panel may depend from the lid portion front panel along a line of weakness such that the lid portion front under panel is the removable laminar blank.

The lid-defining blank portion may further comprise an additional lid portion under panel depending from the lid portion front under panel, wherein the removable laminar blank is at least partially defined by the additional lid portion under panel. The removable laminar blank may be defined by both the lid portion front under panel and the additional lid portion under panel.

As used herein, the terms "front", "back", "upper", "lower", "top", "bottom" and "side", refer to the relative positions of portions of containers according to the invention and components thereof when the container is in an upright position with the lid portion in the closed position. Where the container has a hinge line joining the lid portion and the box portion, the hinge line is at the back of the container. When describing containers according to the present invention, these terms are used irrespective of the orientation of the container being described.

The term "hinge line" refers in particular to a line about which the lid portion may be pivoted in order to open the container. A hinge line may be, for example, a pre-folded fold line or a score line in the panels forming the back wall of the container.

The terms "longitudinal", "transverse", "proximal" and "distal" are defined in terms of the elongate cleaning tool which results from folding or bending the removable laminar blank. As such, the term "longitudinal" refers to the direction along the length of the elongate cleaning tool, and the term "transverse" refers to the direction perpendicular to the longitudinal direction. The term "distal end" refers to the end of the elongate cleaning tool or the removable laminar blank at which the scraping surface is located and which is intended for insertion into a cavity of a device requiring cleaning. The term "proximal end" refers to the end of the elongate cleaning tool or the removable laminar blank which is opposite to the distal end. This is typically the end by which the elongate cleaning tool is grasped during use.

The term "longitudinal line of weakness" refers to a line of weakness which extends primarily in the longitudinal direction of the removable laminar blank. In other words, the longitudinal component of a longitudinal line of weakness is greater than any transverse component of the longitudinal line of weakness. In certain embodiments, one or more longitudinal lines of weakness are substantially parallel to the longitudinal axis of the removable laminar blank. In such embodiments, the one or more longitudinal lines of weakness have substantially no transverse component.

The term "proximal line of weakness" refers to a line of weakness positioned in the proximal half of the removable laminar blank. The proximal line of weakness may be exclusively in the proximal half of the removable laminar blank. The proximal line of weakness may be positioned exclusively in the proximal third, or proximal quarter of the removable laminar blank. The proximal line of weakness may extend from the proximal edge of the removable laminar blank. For example, the proximal line of weakness may extend at an angle from the proximal edge of the removable laminar blank towards a longitudinal edge of the removable laminar blank. The proximal line of weakness may extend across the width of the removable laminar blank. The proximal line of weakness may be proximate to but spaced from the proximal edge of the removable laminar blank.

The term "transverse fold line" refers to a line along which the removable laminar blank, or part of the removable laminar blank, may be folded, which extends primarily in the transverse direction of the removable laminar blank. In other words, the transverse component of a transverse fold line is greater than any longitudinal component of the transverse fold line. In certain embodiments, a transverse fold line is substantially perpendicular to the longitudinal axis of the removable laminar blank. In such embodiments, the transverse fold line has substantially no longitudinal component. The transverse fold line may be a transverse line of weakness.

The term "length" refers to the maximum dimension of the elongate cleaning tool in the longitudinal direction. The term "diameter" refers to the maximum dimension of the elongate cleaning tool in the transverse direction.

The term "elongate cleaning tool" refers to a cleaning tool having a length which is greater than its diameter. For example, the elongate cleaning tool may have a length which is at least twice the diameter of the cleaning tool.

The term "longitudinal side edges" refer to the edges of the removable laminar blank which extend between the proximal and distal ends of the removable laminar blank. The longitudinal side edges may be linear, or non-linear. The longitudinal side edges may be continuous or non-continuous.

The term "inner surface" is used throughout the specification to refer to the surface of a component of the assembled container that is facing towards the interior of the container, for example towards the aerosol-generating articles, when the container is in the closed position. Likewise, the term "outer surface" is used throughout the specification to refer to the surface of a component of the container that is facing towards the exterior of the container. For example, where the container comprises an inner frame, the inner frame comprises an outer surface that is facing the outer housing of the container and an inner surface that is facing the inner package of the container. It should be noted, that the inside or outside surface is not necessarily equivalent to a certain side of a laminar blank used in assembly of the container. Depending on how the laminar blank is folded around the aerosol-generating articles during manufacture, areas that are on the same side of the container can either face towards the inside or the towards the outside of the container.

Aerosol-generating articles, such as smoking articles and typically provided as a bundle of aerosol-generating articles housed in the box portion of the container. The bundle of aerosol-generating articles housed in the box portion is commonly wrapped in an inner liner, or inner package, of metallised paper, metal foil or other flexible sheet material. To access the bundle of aerosol-generating articles within the inner liner, a consumer should remove an upper portion of the inner liner upon first opening of the container.

In hinge-lid containers, the lid often further comprises a lid portion front wall under panel, or lid front flap, extending from the lower edge of the lid portion front wall along a fold line. When the container is assembled from a laminar blank, the lid front flap is folded inwards and typically secured to the inner surface of the lid portion front wall. This increases the stiffness of the lid, while at the same time improving the finish and appearance of the front of the container. Containers comprising one such lid front flap are known, for example, from WO 2010/001335 and EP 2789547.

In order to facilitate and guide the folding of a laminar blank to form a container of the type described above, a line of weakness, such as a creasing line, is generally provided at the lower edge of the lid portion front wall, whereby the lid front flap can easily be folded inwards by approximately 180 degrees to lie against the inside of the lid portion front wall. To this end, a strip of laminar blank material is continuously fed to a machine provided with one or more creasing units adapted to produce local, linear depressions in the laminar material such that the flexural stability of the latter is reduced. Thus, the laminar blank material can conveniently be bent or folded along the creasing line(s) by a folding machine. The same process may be used to provide lines of weakness on the removable laminar blank along which the removable laminar blank is foldable.

Where one or more lines of weakness are provided as a creasing line, or an ablation line, preferably, one or more of the lines of weakness has a residual thickness of less than about 30 percent of the thickness (T) of the laminar blank in which the line of weakness is formed. More preferably, one or more of the lines of weakness may have a residual thickness of less than about 20 percent, less than about 10 percent, or less than about 5 percent, of the thickness (T) of the laminar blank in which the line of weakness is formed.

The term "residual thickness" is used herein to refer to the minimum distance measured between two opposite surfaces of a laminar blank or of a wall of the container formed from a laminar blank. In practice, the distance at a given location is measured along a direction locally perpendicular to the opposite surfaces. The "residual thickness" of an ablation line or a creasing line may be constant if material is removed or compressed homogenously substantially over the width of the line (flat profile). Alternatively, the residual thickness may vary across a width of an ablation line or a creasing line, if material is removed non-homogeneously over the width of the line (e.g. V-shaped, U-shaped grooves).

Containers according to the present invention may be formed from a laminar blank. The laminar blank may be formed from any suitable material or combination of materials, including, but not limited to, cardboard, paperboard, plastic, metal, or combinations thereof. Preferably, the blank is a laminar cardboard blank having a weight of between about 100 grams per square metre and about 350 grams per square metre. In preferred embodiments, the blank has a thickness of from about 100 micrometres to about 500 micrometres, preferably from about 200 micrometres to about 350 micrometres.

Containers according to the present invention may optionally comprise an outer wrapper, which is preferably a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. In addition, the outer wrapper may be printed with images, consumer information or other data.

Further, the aerosol-generating articles may be provided within the container in the form of a bundle wrapped in an inner package formed of metal foil or metallised paper. The inner package material may be formed as a laminate of a metallised polyethylene film, and a liner material. The liner material may be a super-calendered glassine paper. In addition, the inner package material may be provided with a print-receptive top coating. The inner package has an access opening through which aerosol-generating articles can be removed when the lid of the container is in a respective open position.

The container is preferably a rectangular parallelepiped comprising two wider walls spaced apart by two narrower walls. Containers according to the invention may be in the shape of a rectangular parallelepiped, with right-angled longitudinal and right-angled transverse edges. Alternatively, the container may comprise one or more rounded longitudinal edges, rounded transverse edges, bevelled longitudinal edges or bevelled transverse edges, or combinations thereof. Alternatively, the container may have a non-rectangular transversal cross section, for example polygonal such as triangular or hexagonal, semi-oval or semi-circular.

Through an appropriate choice of the dimensions, containers according to the invention may be designed to hold different total numbers of aerosol-generating articles, or different arrangements of aerosol-generating articles. For example, through an appropriate choice of the dimensions, containers according to the invention may be designed to hold a total of between ten and thirty aerosol-generating articles, such as smoking articles. The aerosol-generating articles may be arranged in different collations, depending on the total number.

Preferably, containers according to the invention have a height of between about 40 millimetres and about 150 millimetres, more preferably a height of between about 40 millimetres and about 60 millimetres, wherein the height is measured from the bottom wall to the top wall of the container. In one particular embodiment, the container has a height of 48 millimetres.

Preferably, containers according to the invention have a width of between about 12 millimetres and about 150 millimetres, more preferably a width of between about 50 millimetres and about 90 millimetres, wherein the width is measured from one side wall to the other side wall of the container. In one particular embodiment, the container has a width of 72 millimetres.

Preferably, containers according to the invention have a depth of between about 6 millimetres and about 150 millimetres, more preferably a depth of between about 12 millimetres and about 25 millimetres wherein the depth is measured from the front wall to the back wall of the container. In one particular embodiment, the container has a depth of 15 millimetres.

Preferably, the ratio of the height of the container to the depth of the container is in between about 0.3 to 1 and about 10 to 1, more preferably between about 2 to 1 and about 8 to 1, most preferably between about 2 to 1 and 4 to 1.

Preferably, the ratio of the width of the container to the depth of the container is in between about 0.3 to 1 and about 10 to 1, more preferably between about 2 to 1 and about 8 to 1, most preferably between about 4 to 1 and 6 to 1.

Preferably, the ratio of the height of the lid back wall to the height of the box back wall of the outer sleeve is between about 0 to 1 (lid located at the top edge of the container) to about 1 to 1, more preferably, between about 1 to 3 and about 1 to 8, most preferably, between about 1 to 4 to about 1 to 6.

Aerosol-generating articles for use with or storage in containers according to the invention comprise an aerosol-forming substrate that is vaporised, during use, by an aerosol-generating device to form an aerosol.

As used herein, the term 'aerosol-forming substrate' relates to a substrate capable of releasing volatile compounds that can form an aerosol. Such volatile compounds may be released by heating the aerosol-forming substrate.

As used herein, the term 'aerosol-generating article' refers to an article comprising an aerosol-forming substrate that is capable of releasing volatile compounds that can form an aerosol. For example, an aerosol-generating article may be an article that generates an aerosol that is directly inhalable into a user's lungs by the using drawing or puffing on a mouthpiece at a proximal or user-end of the system. An aerosol-generating article may be disposable. An article comprising an aerosol-forming substrate comprising tobacco is referred to as a tobacco stick.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

The aerosol-generating article may have a total length between approximately 30 millimetres and approximately 100 millimetres. In one embodiment, the aerosol-generating article has a total length of approximately 45 millimetres.

The aerosol-generating article may have an external diameter of between approximately 5 millimetres and approximately 12 millimetres, for example of between approximately 6 millimetres and approximately 8 millimetres. In a preferred embodiment, the aerosol-generating article has an external diameter of 7.2 millimetres+1-10 percent.

The aerosol-forming substrate may have a length of between about 7 millimetres and about 15 millimetres. In one embodiment, the aerosol-forming substrate may have a length of approximately 10 millimetres. Alternatively, the aerosol-forming substrate, or the liquid retention medium, may have a length of approximately 12 millimetres.

The aerosol-generating substrate preferably has an external diameter that is approximately equal to the external diameter of the aerosol-generating article. The external diameter of the aerosol-forming substrate may be between approximately 5 millimetres and approximately 12 millimetres. In one embodiment, the aerosol-forming substrate may have an external diameter of approximately 7.2 millimetres+1-10 percent.

The aerosol-forming substrate may be a solid aerosol-forming substrate. The aerosol-forming substrate may comprise a tobacco-containing material containing volatile tobacco flavour compounds which are released from the substrate upon heating. Alternatively, the aerosol-forming substrate may comprise a non-tobacco material. The aerosol-forming substrate may further comprise an aerosol former that facilitates the formation of a dense and stable aerosol. As used herein, the term 'aerosol former' is used to describe any suitable known compound or mixture of compounds that, in use, facilitates formation of an aerosol. Suitable aerosol formers are substantially resistant to thermal degradation at the operating temperature of the aerosol-generating article. Examples of suitable aerosol formers are glycerine and propylene glycol.

In a particularly preferred embodiment, the aerosol-forming substrate comprises a gathered crimped sheet of homogenised tobacco material. As used herein, the term 'crimped sheet' denotes a sheet having a plurality of substantially parallel ridges or corrugations.

Aerosol-generating articles for use with or storage in containers according to the present invention may further comprise a support element may be located immediately downstream of the aerosol-forming substrate. The support element may abut the aerosol-forming substrate. The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate. The support element may comprise a hollow tubular element. For example, the support element comprises a hollow cellulose acetate tube. The support element preferably has an external diameter that is approximately equal to the external diameter of the aerosol-generating article. The support element may have an external diameter of between approximately 5 millimetres and approximately 12 millimetres, for example of between approximately 5 millimetres and approximately 10 millimetres or of between approximately 6 millimetres and approximately 8 millimetres. For example, the support element may have an external diameter of 7.2 millimetres+1-10 percent. The support element may have a length of between approximately 5 millimetres and approximately 15 millimetres. In a preferred embodiment, the support element has a length of approximately 8 millimetres.

An aerosol-cooling element may be located downstream of the aerosol-forming substrate, for example an aerosol-cooling element may be located immediately downstream of a support element, and may abut the support element. The aerosol-cooling element may be located immediately downstream of the aerosol-forming substrate. For example, the aerosol-cooling element may abut the aerosol-forming substrate. The aerosol-cooling element may have a total surface area of between approximately 300 square millimetres per millimetre length and approximately 1000 square millimetres per millimetre length. In a preferred embodiment, the aerosol-cooling element has a total surface area of approximately 500 square millimetres per millimetre length. The aerosol-cooling element preferably has a low resistance to draw. That is, the aerosol-cooling element preferably offers a low resistance to the passage of air through the aerosol-generating article. Preferably, the aerosol-cooling element does not substantially affect the resistance to draw of the aerosol-generating article. The aerosol-cooling element may comprise a plurality of longitudinally extending channels. The plurality of longitudinally extending channels may be defined by a sheet material that has been one or more of crimped, pleated, gathered and folded to form the channels. The plurality of longitudinally extending channels may be defined by a single sheet that has been one or more of crimped, pleated, gathered and folded to form multiple channels. Alternatively, the plurality of longitudinally extending channels may be defined by multiple sheets that have been one or more of crimped, pleated, gathered and folded to form multiple channels.

In some embodiments, the aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil. In a preferred embodiment, the aerosol-cooling element comprises a gathered sheet of biodegradable material. For example, a gathered sheet of non-porous paper or a gathered sheet of biodegradable polymeric material, such as polylactic acid or a grade of Mater-Bi® (a commercially available family of starch based copolyesters). In a particularly preferred embodiment, the aerosol-cooling element comprises a gathered sheet of polylactic acid.

The aerosol-cooling element may be formed from a gathered sheet of material having a specific surface area of between approximately 10 square millimetres per milligram and approximately 100 square millimetres per milligram weight. In some embodiments, the aerosol-cooling element may be formed from a gathered sheet of material having a specific surface area of approximately 35 $mm^2/mg$.

The aerosol-generating article may comprise a mouthpiece located at the mouth end of the aerosol-generating article. The mouthpiece may be located immediately downstream of an aerosol-cooling element and may abut the aerosol-cooling element. The mouthpiece may be located immediately downstream of the aerosol-forming substrate or, where the article comprises a liquid retention medium for retaining a liquid aerosol-forming substrate, immediately downstream of the liquid retention medium. In such embodiments, the mouthpiece may abut the aerosol-forming substrate, or the liquid retention medium. The mouthpiece may comprise a filter. The filter may be formed from one or more suitable filtration materials. Many such filtration materials are known in the art. In one embodiment, the mouthpiece may comprise a filter formed from cellulose acetate tow.

The mouthpiece preferably has an external diameter that is approximately equal to the external diameter of the aerosol-generating article. The mouthpiece may have an external diameter of a diameter of between approximately 5 millimetres and approximately 10 millimetres, for example of between approximately 6 millimetres and approximately 8 millimetres. In a preferred embodiment, the mouthpiece has an external diameter of 7.2 millimetres+1-10%.

The mouthpiece may have a length of between approximately 5 millimetres and approximately 20 millimetres. For example, the mouthpiece may have a length of from about 7 millimetres to about 12 millimetres.

The aerosol-generating article may comprise a filter plug. The filter plug may be located at a downstream end of the aerosol-generating article. The filter plug may be a cellulose acetate filter plug. The filter plug is approximately 7 millimetres in length in one embodiment, but may have a length of between approximately 5 millimetres to approximately 10 millimetres.

The elements of the aerosol-forming article may be circumscribed by an outer wrapper, for example in the form of a rod. The outer wrapper may be formed from any suitable material or combination of materials. Preferably, the outer wrapper is non-porous.

It shall be appreciated that any features described with reference to one aspect of the present invention are equally applicable to any other aspect of the invention. In particular, features described with reference to containers of the first and second aspects are applicable to containers of the third aspect, and vice versa.

The invention will be further described, by way of example only, with reference to the accompanying drawings in which.

Figure 1:
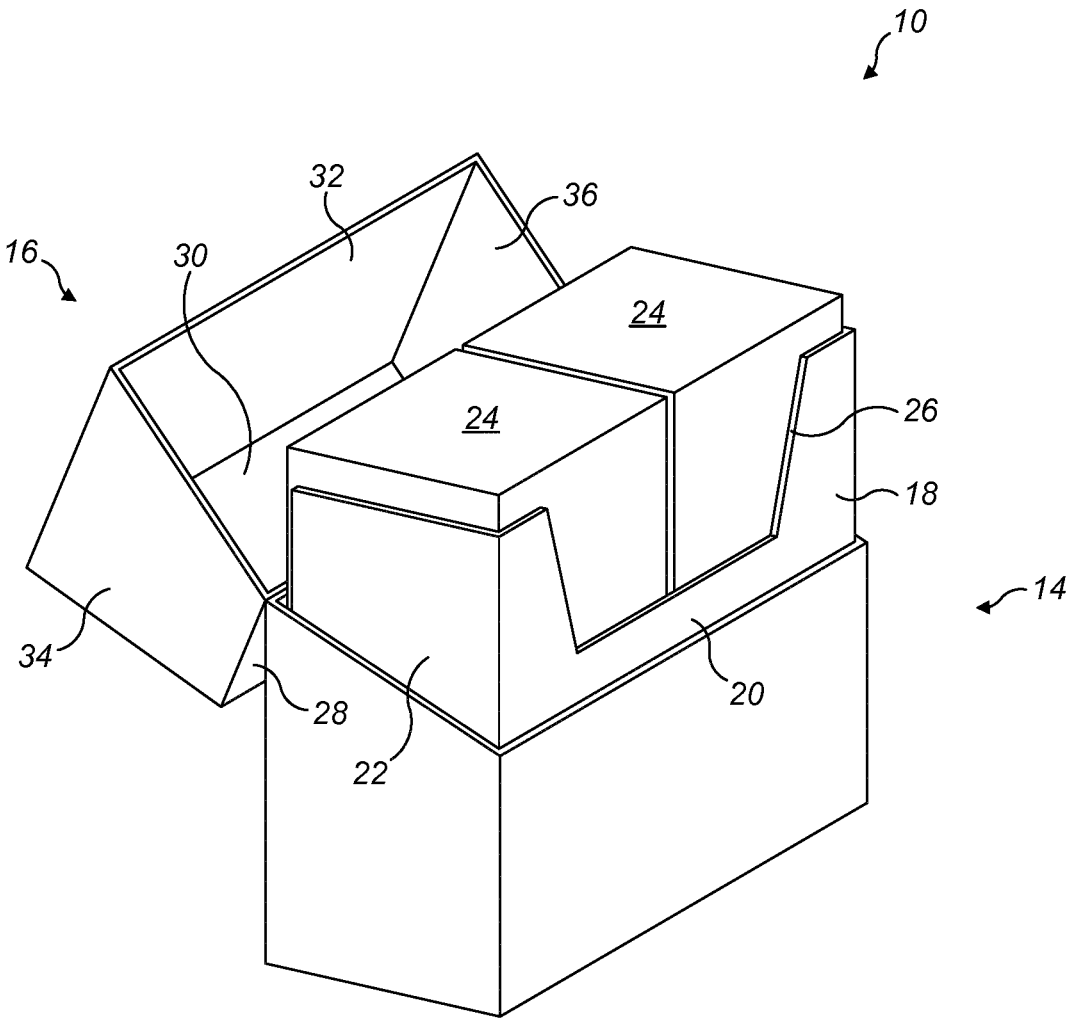
FIG. 1 shows a front perspective view of a first embodiment of container in accordance with the present invention, with the lid portion in an open position.

FIG. 1 shows a first embodiment of container 10 of aerosol-generating articles in accordance with the present invention. The container, or pack, 10 comprises an outer package formed from a folded laminar blank and having a box portion 14 and a lid portion 16 hinged to the rear wall of the box portion 14. In use, the front of the lid 16 is pivoted up and to the rear by the consumer to open the pack 10 and thereby allow access to its contents, as shown in FIG. 1. The pack 10 also includes an inner frame 18 inside the front and sides of the box portion 14. At least a portion of the inner frame 18 extends above the box portion 14 into the space covered by the lid 16 in the closed position. The inner frame 18 is formed from a folded laminar blank and has a front wall 20 and side walls 22 extending rearwardly from the side edges of the front wall 20. Standing in the box portion 14 and between the side walls 22 of the inner frame 18 are two individually foil wrapped bundles 24 of aerosol-generating articles. A central cut-out 26 is provided in the front wall 20 of the inner frame to allow the consumer to remove smoking articles from the pack 10 in the open position. As well as reinforcing the front and sides of the pack 10, the inner frame 18 provides some interference or frictional engagement with the lid 16 as it opens and closes, thereby helping to prevent accidental opening of the pack 10 and to retain the lid 16 in the closed position when desired.

The lid portion 16 comprises a lid portion back wall 28 depending from the box portion back wall, a lid portion top wall 30 depending from the lid portion back wall 28, and a lid portion front wall 32 depending from the lid portion top wall 30. First and second lid portion side walls 34, 36 depend from the lid portion back, top and front walls.

Figure 2:
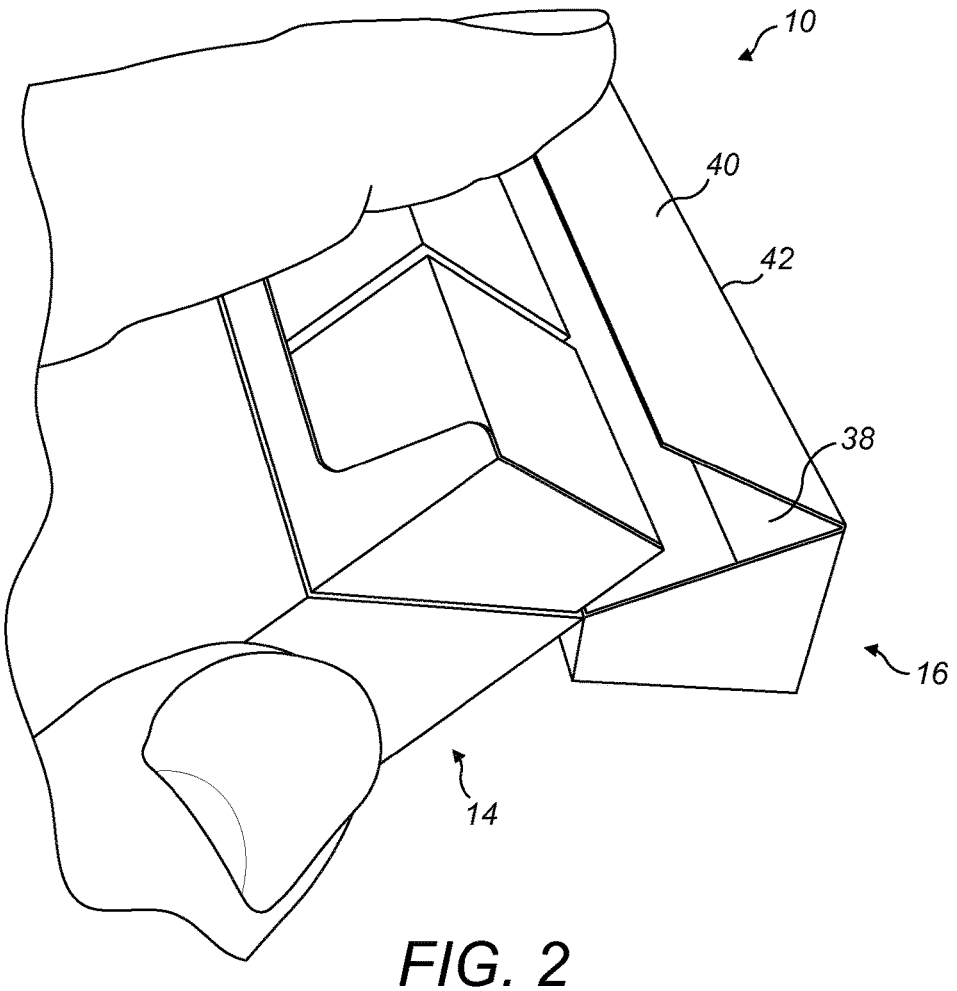
FIG. 2 shows a partial perspective view of the container of FIG. 1 with the lid portion in an open positon and with the removable laminar blank in an outwardly folded position.

As shown in FIG. 2, the lid portion front wall 32 comprises a lid portion front panel 38 depending from the lid portion top wall 30, and a lid portion front wall under panel 40 extending from the lower edge of the lid portion front wall 32 along a fold line. 42. When the container 10 is assembled from a laminar blank, the lid portion front wall under panel 40, or lid front flap, is folded inwards against the inner surface of the lid portion front panel 38. In order to facilitate and guide the folding of a laminar blank to form a container of the type described above, the fold line 42 is a line of weakness at the lower edge of the lid portion front wall 32, whereby the lid front flap 40 can easily be folded inwards by approximately 180 degrees to lie against the inside of the lid portion front panel 38. When the lid portion 16 is opened, the lid front flap 40 may be unfolded outwards along the fold line 42 by a user, as shown.

In this example, the fold line 42 comprises a plurality of perforations to allow the lid front flap 40 to be removed from the container 10 by breaking the container 10 along the fold line 42. In this example, the lid front flap 40 is a removable laminar blank 50 and defines the entire removable laminar blank 50. In other examples, an additional line of weakness (not shown) may be provided at any other position across the width of the lid portion front wall 32 to allow part of the lid portion front wall 32 to be removed from the container 10 along the line of weakness. In such examples, the removable laminar blank may be defined by only part of the lid front flap 40, by the lid front flap 40 and part of the lid portion front panel 38, or by an additional lid portion under panel extending from the lid front flap 40.

Figure 3:
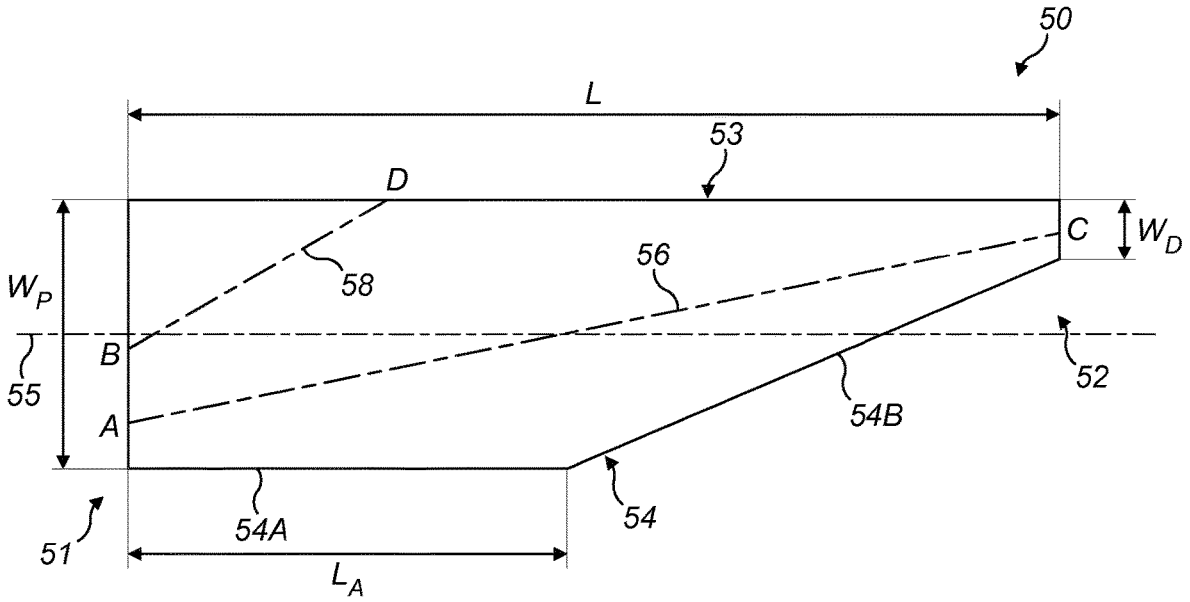
FIG. 3 shows a plan view of a first embodiment of removable laminar blank for the container of FIG. 1.

As shown in FIG. 3, the removable laminar blank 50 defined by the lid front flap 40 is planar and has a generally rectangular elongate shape with a diagonal cut across one corner. The removable laminar blank 50 has a proximal end 51 and a distal end 52, and first and second longitudinal side edges 53, 54 extending along the length of the removable laminar blank from the proximal end 51 to the distal end 52. The first longitudinal side edge 53 extends along the fold line 42 and is parallel with the longitudinal axis 55 of the removable laminar blank 50. The second longitudinal side edge 54 has a first portion 54A extending from the proximal end 51 which is parallel with the longitudinal axis 55, and a second portion 54B which extends at an angle from the first portion 54A to the distal end 52 to form a taper towards the distal end 52. The removable laminar blank 50 also has a longitudinal line of weakness 56 and a proximal line of weakness 58. The longitudinal line of weakness 56 extends along the entire length of the blank 50 between the proximal and distal ends 51, 52 and at an angle to the longitudinal axis 55. The proximal line of weakness 58 extends at an angle from the proximal end 51 to part way along the length of the first longitudinal side edge 53.

The removable laminar blank 50 has a total length L, a width $W_P$ at the proximal end 51, and a width $W_D$ at the distal end 52 which is less than the width $W_P$ at the proximal end 51. The first portion 54A of the second longitudinal side edge 54 has a length of LA. This is the distance from the proximal end 51 at which the second longitudinal side edge 54 starts to taper towards the distal end 52. The longitudinal line of weakness 56 extends from point A on the proximal edge 51 to point Con the distal edge 52. The proximal line of weakness 58 extends from point B on the proximal edge 52 to point D on the first longitudinal side edge 53.

In a particularly preferred example, the total length L is 72 millimetres, the first portion 54A has a length LA of 34 millimetres the width $W_P$ at the proximal end 43 is 18 millimetres, the width $W_D$ at the distal end 52 is 4 millimetres, point A is 3 millimetres from the first portion 54A of the second longitudinal side edge 54, point B is 10 millimetres from the first longitudinal side edge 53, point C is 2 millimetres from the first longitudinal side edge 53, and point D is 20 millimetres from the proximal end 51.

Figure 4:
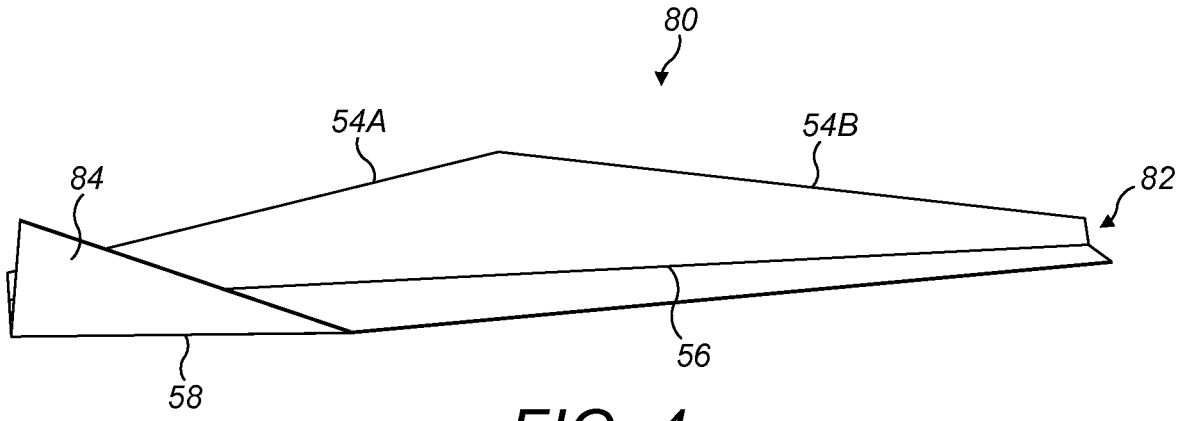
FIG. 4 shows a perspective view of an elongate cleaning tool formed from the removable laminar blank of FIG. 3.

FIG. 4 shows an elongate cleaning tool 80 formed from the removable laminar blank 50. To form the cleaning tool 80, the removable laminar blank is first removed from the rest of the container, by tearing along fold line 42, and is folded in a first direction both along the longitudinal line of weakness 56 and along the proximal line of weakness 58. The elongate cleaning tool 80 has a scraping surface 82 at its distal end, a handle 84 at its proximal end, and an open shape with a generally V-shaped cross-section. As the longitudinal line of weakness 56 and the second portion 54B of the second longitudinal side edge 54 of the removable laminar blank are non-parallel to the longitudinal axis 55 of the removable laminar blank, the resulting elongate cleaning tool 80 tapers towards the scraping surface 82 at its distal end. This may facilitate the ease with which the cleaning tool 80 is inserted into a cavity. A narrow scraping surface 82 may facilitate mechanical cleaning of debris in the cavity. The handle 84 is formed by folding the removable laminar blank outwardly along the proximal line of weakness.

Figure 5:
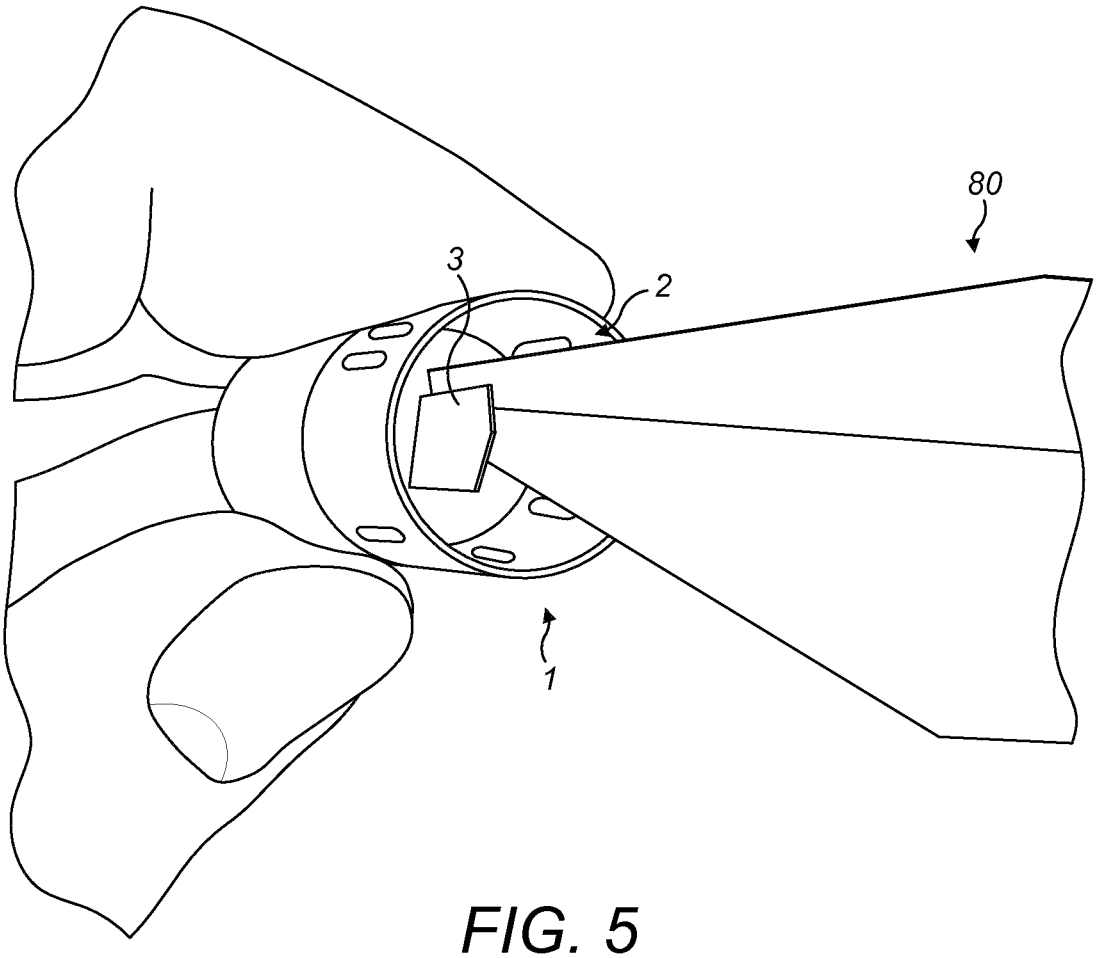
FIG. 5 shows a partial perspective view of the elongate cleaning tool of FIG. 4 in use in the cavity of an aerosol-generating device.

FIG. 5 shows the elongate cleaning tool 80 when inserted into the cavity 2 of an aerosol-generating device 1. The open shape of the elongate cleaning tool 80 allows the tool 0 to be positioned around a heater blade 3 in the cavity 2. The heater blade 3 and the cavity 2 may then be mechanically cleaned with the scraping surface by gripping the tool 80 by the handle and moving the tool 80 around within the cavity 2. Once the cavity 2 has been cleaned, the elongate cleaning tool 80 is withdrawn from the cavity 2 and the aerosol-generating device 1 is then inverted to allow dislodged debris to fall out of the cavity 2. The aerosol-generating device 1 may then be used again as normal.

Figure 6:
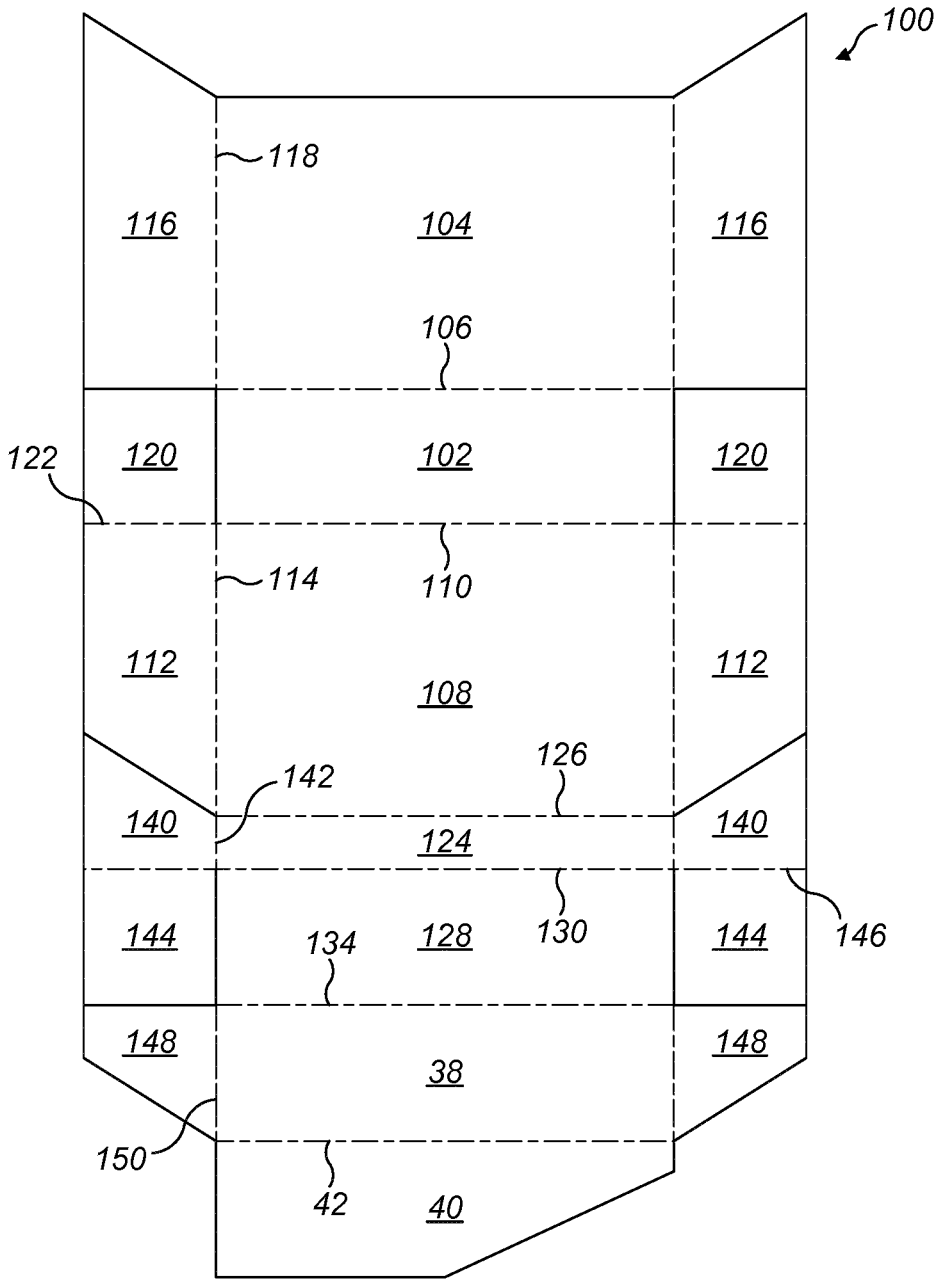
FIG. 6 shows a plan view of a laminar blank for forming the container of FIG. 1.

FIG. 6 shows a laminar blank 100 for forming the container 10 of the first embodiment. Solid lines represent cut lines and dashed lines represent lines of weakness, such as scoring lines, along which the laminar blank 100 is folded to form the container 10. The laminar blank 100 comprises a box portion bottom panel 102, a box portion front panel 104 depending along a fold line 106 from the box portion bottom panel, and a box portion back panel 108 depending along a fold line 110 from the box portion bottom panel 102. First box portion side panels 112 depend along fold lines 114 from the box portion back panel 108 and second box portion side panels 116 depend along fold lines 118 from the box portion front panel 104. Two box portion dust flaps 120 depend along fold lines 122 from the first box portion side panels 112.

The laminar blank 100 further comprises a lid portion back panel 124 depending along a fold line 126 from the box portion back panel 108, a lid portion top panel 128 depending along a fold line 130 from the lid portion back panel, and a lid portion front panel 38 depending along a fold line 134 from the lid portion top panel 128. A lid portion front under panel 40 depends along a fold line 42 from the lid portion front panel 38. The laminar blank 100 also comprises first lid portion side flaps 140 depending along fold lines 142 from the lid portion back panel 124, dust flaps 144 depending along fold lines 146 from the first lid portion side flaps 140, and second lid portion side flaps 148 depending along fold lines 150 from the lid portion front panel 38. When the laminar blank 100 is folded to form the box portion 12 and the lid portion 14 shown in FIG. 1, each pair of first and second lid portion side flaps 140, 148 overlap each other to form the lid portion side walls 34, 36. The dust flaps 144 are folded about the fold lines 146 so that they underlie the lid portion top panel 42. The lid portion front under panel 40 is folded about the fold line 42 to underlie the lid portion front panel 38 and, together with the lid portion front panel 38, form the lid portion front wall 32.

Figure 7:
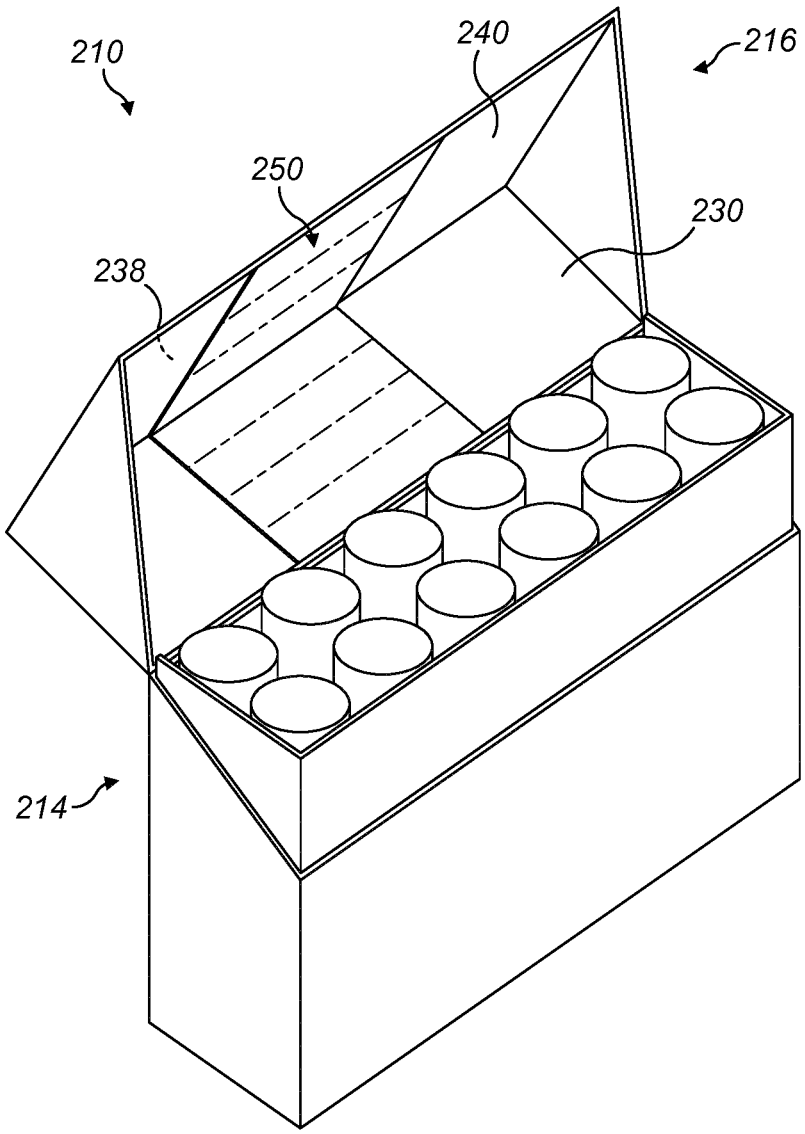
FIG. 7 shows a front perspective view of a second embodiment of container in accordance with the present invention, with the lid portion in an open position.

FIG. 7 shows a second embodiment of container 210 of aerosol-generating articles in accordance with the present invention. As with the container of the first embodiment, the container, or pack, 210 comprises an outer package formed from a folded laminar blank and having a box portion 214 and a lid portion 216 hinged to the rear wall of the box portion 214 and including a removable laminar blank 250. However, unlike the container 10 of the first embodiment, the removable laminar blank 250 is provided as a discrete component, or insert, which is removably secured to an inner surface of the lid portion 216. For example secured to both the top wall 230 and the lid portion front wall. The removable laminar blank 250 may be secured to the lid portion 216 by any suitable means. For example, the removable laminar blank 250 may be received in a pocket formed between the lid portion front panel 238 and the lid portion under panel 240. In a preferred embodiment, the removable laminar blank 250 is removably secured to the lid portion 216 by a pressure sensitive adhesive. In a similar manner to the container 10 of the first embodiment, the removable laminar blank 250 may be removed from the container 210 and folded to form an elongate cleaning tool, as discussed below in relation to FIGS. 8 to 10B.

Figure 8:
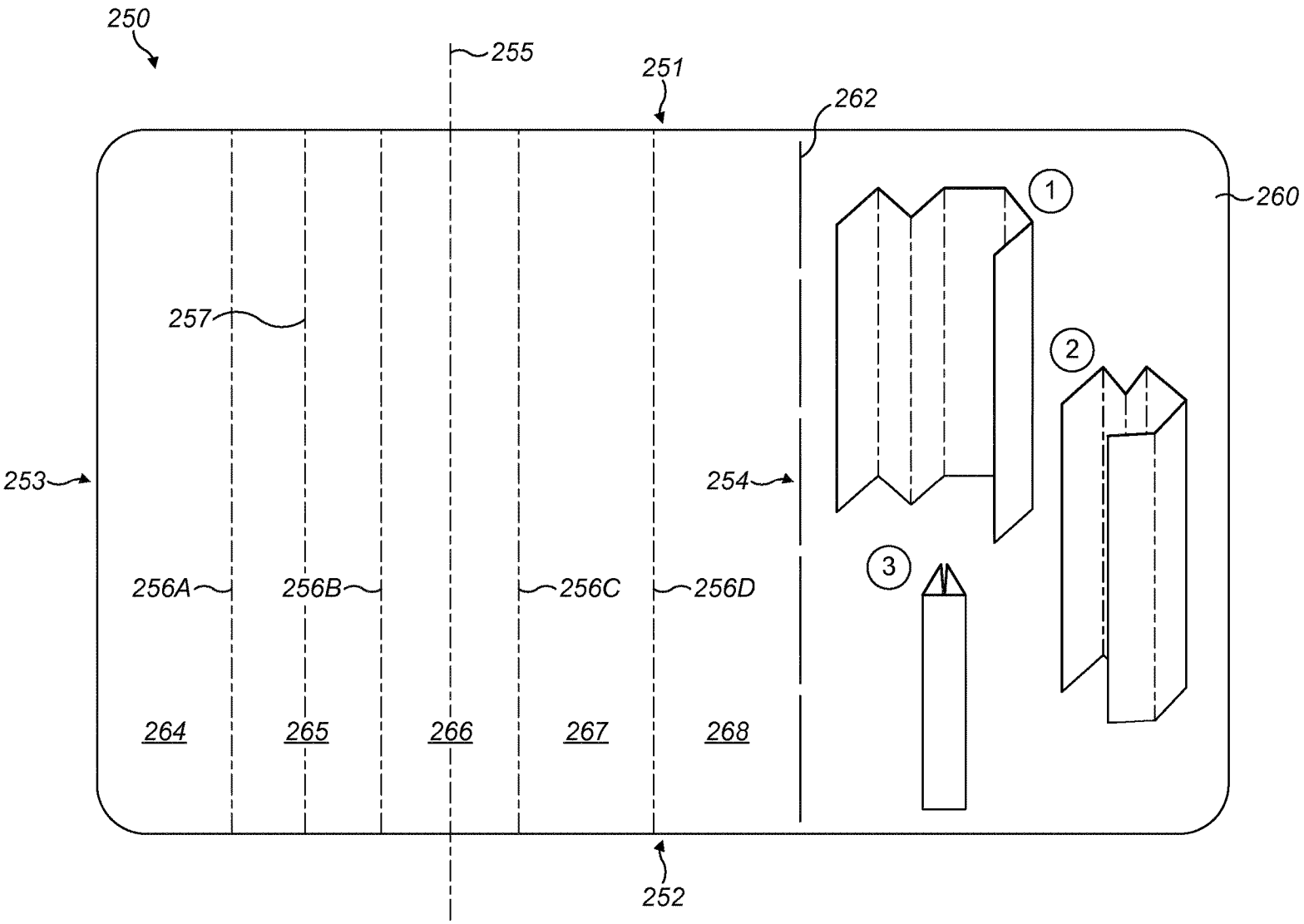
FIG. 8 shows a plan view of a second embodiment of removable laminar blank for the containers of FIG. 1 and FIG. 7.

FIG. 8 shows a removable laminar blank 250 according to a second embodiment for the container 210 of the second embodiment. As shown in FIG. 8, the removable laminar blank 250 is planar and has a generally rectangular elongate shape. In this example, the removable laminar blank 250 has an additional flap 260 containing a series of printed instructions for forming an elongate cleaning tool from the removable laminar blank 250. The additional flap 260 is attached to the rest of the removable laminar blank 250 by a perforated line 262 and is removed by tearing along the perforated line 262 prior to folding the removable laminar blank 250. The first and second longitudinal side edges 253, 254 are parallel with each other and with the longitudinal axis 255 of the removable laminar blank 250. A plurality of longitudinal lines of weakness 256 extend along the length of the removable laminar blank 250 parallel to the longitudinal side edges 253, 254. The removable laminar blank 250 further comprises an additional longitudinal line of weakness 257 which is parallel to the plurality of longitudinal lines of weakness 256 and positioned between two adjacent longitudinal lines of weakness 256.

The removable laminar blank 250 is divided into a series of panels by the longitudinal lines of weakness 256. In particular, the removable laminar blank comprises a first panel 264 between the first longitudinal side edge 253 and the adjacent first longitudinal line of weakness 256A, a second panel 265 adjacent to the first panel 264 and between first and second longitudinal lines of weakness 256A, 256B, a third panel 266 adjacent to the second panel 265 and between second and third longitudinal lines of weakness 256B, 256C, a fourth panel 267 between the third and fourth longitudinal lines of weakness 256C, 256D, and a fifth panel 268 between the fourth longitudinal line of weakness 256D and the second longitudinal side edge 254. The second panel 265 is divided into two sub panels by the additional longitudinal line of weakness 257.

Figure 9C:
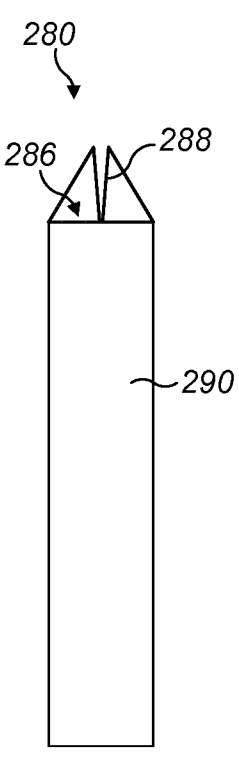
FIGS. 9A, 9B and 9C show perspective views of a folding process for forming an elongate cleaning tool from the removable laminar blank of FIG. 8.
Figure 9B:
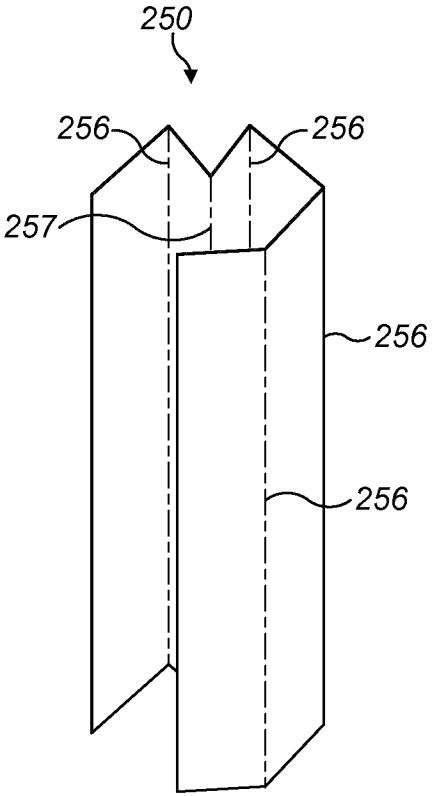
Figure 9A:
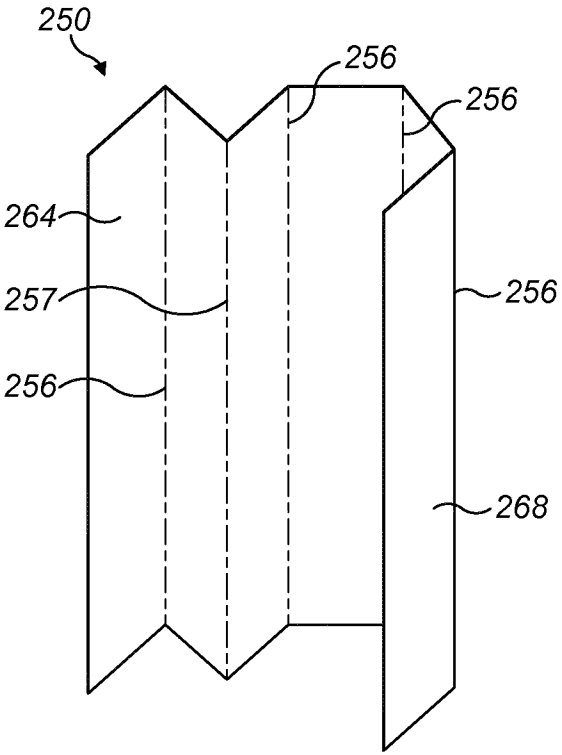

Referring to FIGS. 9A to 9C, the removable laminar blank 250 is folded along the plurality of longitudinal lines of weakness 256 in a first direction and is folded along the additional longitudinal line of weakness 257 in a second, opposite direction to form an elongate cleaning tool 280 having a closed cross-sectional shape and having an internal projection 288 extending into a central lumen 286 of the elongate cleaning tool 280. The internal projection 288 forms part of the scraping surface 282 and has side walls defined by the second panel 265 and an apex 289 formed by the additional longitudinal line of weakness 257. The first, third and fourth panels 264, 266, 267 form side walls 290 of the cleaning tool 280. The fifth panel 268 overlaps with the first panel 265 to provide additional rigidity.

In this example, the removable laminar blank 250 has four evenly spaced longitudinal lines of weakness 256 and a single additional longitudinal line of weakness 257 positioned at the midpoint between two adjacent longitudinal lines of weakness 256. This results in an elongate cleaning tool 280 with a equilateral triangular cross-section and parallel side walls 290, and an internal projection 288 having a width, or radial extent, of approximately half the width of each of the side walls 290. It will be appreciated that different cross-sectional shapes may be provided using different numbers of longitudinal lines of weakness, or by varying the spacing of the longitudinal lines of weakness. It will also be appreciated that cleaning tools with non-parallel side walls may be provided by providing the removable laminar blank with non-parallel longitudinal side edges and non-parallel longitudinal lines of weakness.

Figure 10A:
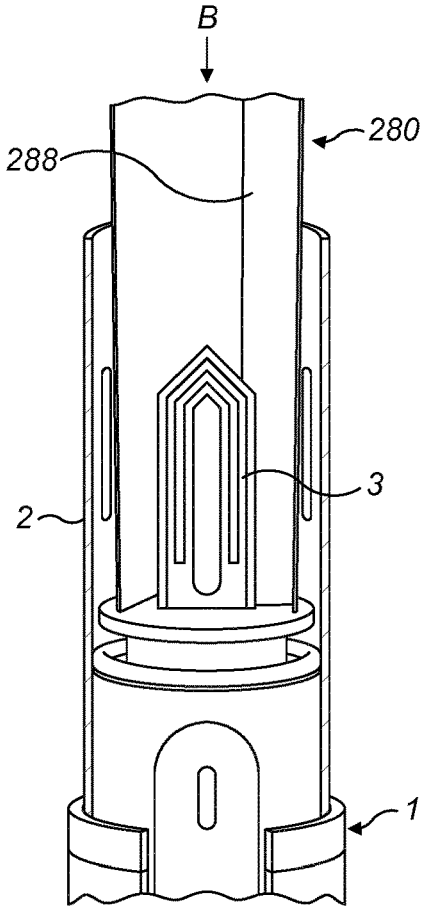
FIG. 10A shows a partial cut-away side perspective view of the elongate cleaning tool of FIG. 9C in use in the cavity of an aerosol-generating device.
Figure 10B:
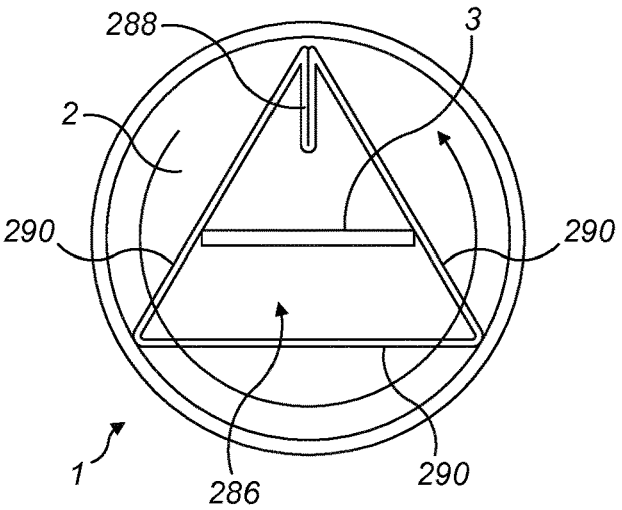
FIG. 10B shows an end view in the direction of arrow B in FIG. 10A.

FIGS. 10A and 10B show the elongate cleaning tool 280 in use in the cavity 2 of an aerosol-generating device 1. The triangular cross-sectional shape of the elongate cleaning tool 280 allows the side walls 290 to be positioned around the heater blade 3 in the cavity 2. The heater blade 3 and the cavity 2 may then be mechanically cleaned with the scraping surface 282 and the internal projection 288 by moving the cleaning tool 280 around within the cavity 2. Advantageously, the side walls of the internal projection 288 provide a flat surface against which the heater blade 3 may be cleaned more effectively. Once the cavity 2 has been cleaned, the elongate cleaning tool 280 is withdrawn from the cavity 2 and the aerosol-generating device 1 is then inverted to allow dislodged debris to fall out of the cavity 2. The aerosol-generating device 1 may then be used again as normal.

Figure 11:
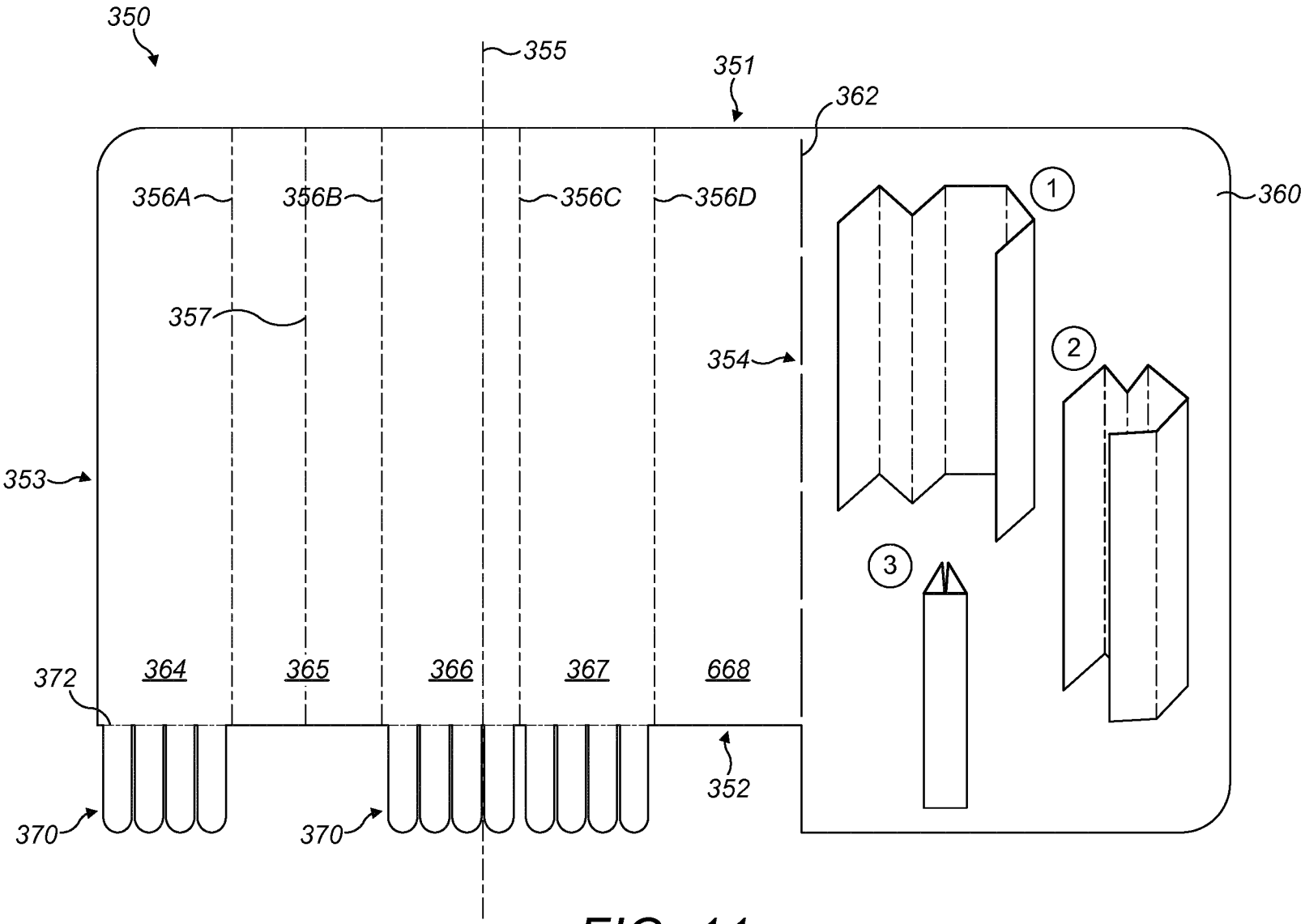
FIG. 11 shows a plan view of a third embodiment of removable laminar blank for the containers of FIG. 1 and FIG. 7.

FIG. 11 shows a removable laminar blank 350 according to a third embodiment for the container 210 of the second embodiment. As shown in FIG. 11, the removable laminar blank 350 is planar and has a generally rectangular elongate shape. The removable laminar blank 350 is similar in construction and operation to the removable laminar blank 250 of the second embodiment and where the same features are present, like reference numerals are used. As with the removable laminar blank 250 of the second embodiment, the removable laminar blank 350 an additional flap 360 containing a series of printed instructions for forming the elongate cleaning tool and which is removably attached to the rest of the removable laminar blank 350 by a perforated line 362. The removable laminar blank 350 also has four evenly spaced longitudinal lines of weakness 356 and a single additional longitudinal line of weakness 357 positioned at the midpoint between two adjacent longitudinal lines of weakness 356. Again, this results in an elongate cleaning tool 380 with a equilateral triangular cross-section and parallel side walls 390, and an internal projection 388 having a width, or radial extent, of approximately half the width of each of the side walls 390. However, unlike the first and second embodiments of removable laminar blank, the third embodiment of removable laminar blank 350 further comprises a plurality of discrete fingers 370 at its distal end 352, each of the discrete fingers 370 being foldable along a transverse fold line 372 to form inwardly extending bristles defining a scraping surface at the distal end of the elongate cleaning tool. In this example, the discrete fingers 370 are provided in groups at the distal end of each of the first, third and fourth panels 364, 366, 367 and not at the distal end of the second panel 365 or the fifth panel 368. This helps to prevent the discrete fingers 370 on adjacent panels from impinging on each other when the removable laminar blank 350 is folded to form the tool 380.

Figure 12:
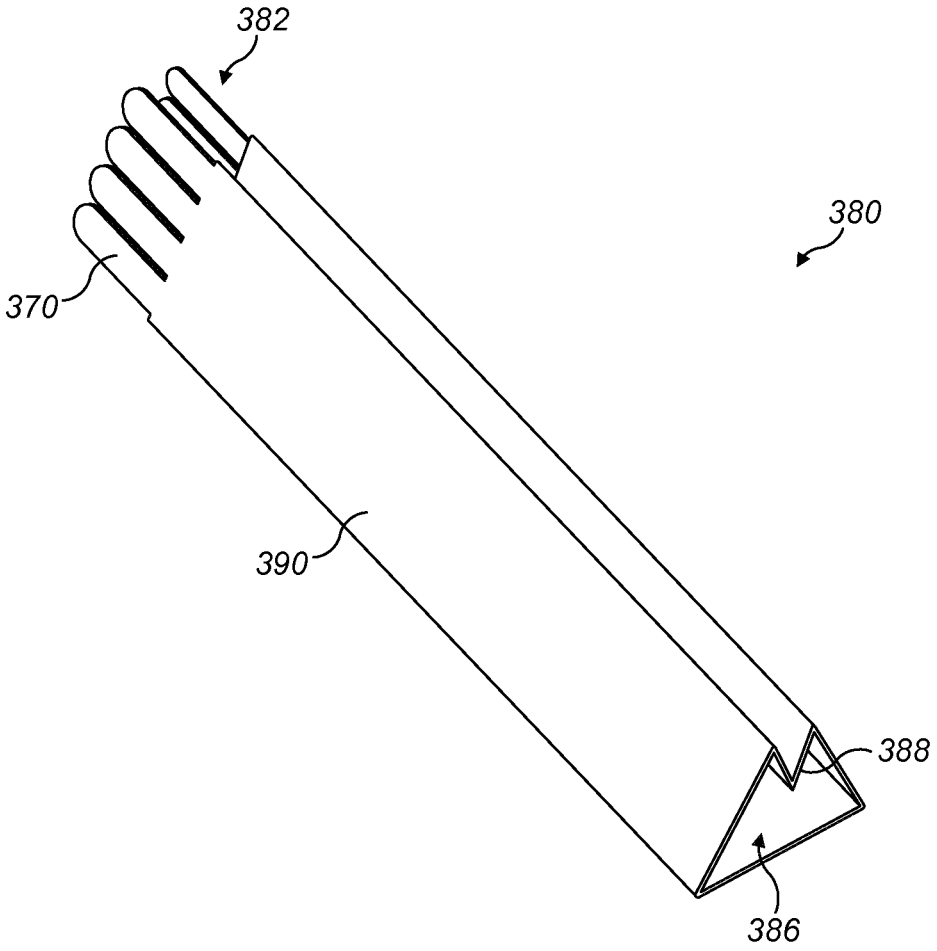
FIG. 12 shows a perspective view of an elongate cleaning tool formed from the removable laminar blank of FIG. 11.

Referring to FIG. 12, the resulting elongate cleaning tool 380 according to the third embodiment is similar in construction to the elongate cleaning tool 280 according to the second embodiment with the addition of a plurality of bristles 392 at the distal end of the tool 380. The bristles 392 are formed by folding each of the discrete fingers 370 of the removable laminar blank 350 along their respective transverse fold line 372 towards the central passage, or lumen 386. The bristles 392 form part of the scraping surface 382 of the tool 380.

Figure 13A:
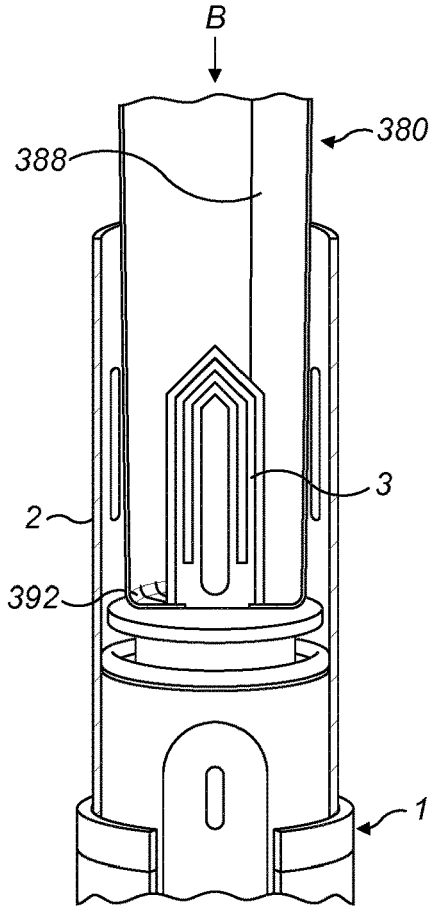
FIG. 13A shows a partial cut-away side perspective view of the elongate cleaning tool of FIG. 12 in use in the cavity of an aerosol-generating device.
Figure 13B:
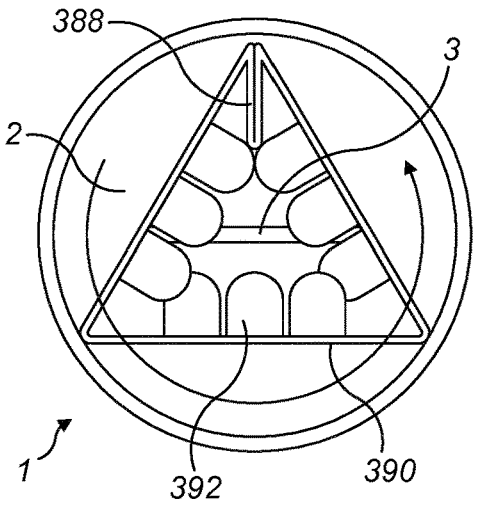
FIG. 13B shows an end view in the direction of arrow B in FIG. 13A.

FIGS. 13A and 13B show the elongate cleaning tool 380 in use in the cavity 2 of an aerosol-generating device 1. The triangular cross-sectional shape of the elongate cleaning tool 380 allows the side walls 390 to be positioned around the heater blade 3 in the cavity 2. The heater blade 3 and the cavity 2 may then be mechanically cleaned with the scraping surface 382, the internal projection 388, and the bristles 392 by moving the cleaning tool 380 around within the cavity 2. Advantageously, the side walls of the internal projection 388 provide a flat surface against which the heater blade 3 may be cleaned more effectively, and the bristles 392 provide an additional cleaning surface to facilitate cleaning. The bristles 392 are pointed towards, and flex around, the internal heater blade 3 during cleaning to accommodate the heater blade 3 and increase the level of contact between the tool 380 and the heater blade 3. The bristles 392 may also allow for a greater scraping force to be applied to the heater blade 3 in a transverse direction. Once the cavity 2 has been cleaned, the elongate cleaning tool 380 is withdrawn from the cavity 2 and the aerosol-generating device 1 is then inverted to allow dislodged debris to fall out of the cavity 2. The aerosol-generating device 1 may then be used again as normal.

Figure 14:
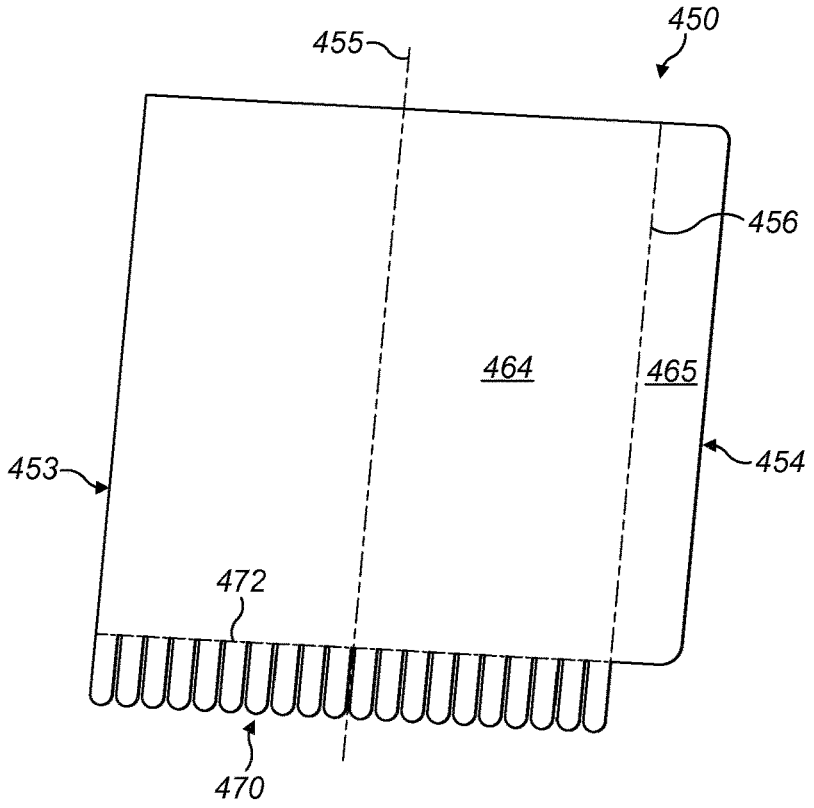
FIG. 14 shows a plan view of a fourth embodiment of removable laminar blank for the containers of FIG. 1 and FIG. 7.

FIG. 14 shows a removable laminar blank 450 according to a fourth embodiment for the container 210 of the second embodiment. As shown in FIG. 14, the removable laminar blank 450 is planar and has a generally rectangular elongate shape. Unlike the second and third embodiments of removable laminar blank, the removable laminar blank 450 of the fourth embodiment comprises only a single longitudinal line of weakness 456 provided adjacent to the second longitudinal side edge 454. The single longitudinal line of weakness 456 is parallel to the first and second longitudinal side edges 453, 454 and the longitudinal axis 455 and divides the removable laminar blank 450 into a first panel 464 and a much smaller second panel 465. Unlike the removable laminar blanks of the first to third embodiments, the removable laminar blank 450 is not folded to form an elongate cleaning tool, but is rolled about its longitudinal axis 455 to form a tubular elongate cleaning tool having a closed circular cross-section. The first panel 464 defines the side wall 490 of the tool 480 and the second panel 465 under lies the first panel 464 to add rigidity to the tool. As with the third embodiment of removable laminar blank 350, a plurality of discrete fingers 470 are provided at the distal end 452 of the removable laminar blank 450, each of the discrete fingers 470 being foldable along a transverse fold line 472 to form inwardly extending bristles defining a scraping surface at the distal end of the elongate cleaning tool. In this example, the discrete fingers 470 are provided at the distal end of the first panel 464 and not at the distal end of the second panel 465. This is because the second panel 465 lies against the first panel 464 when the tool is formed and any fingers on the second panel 465 might impinge against those on the first panel 466.

Figure 15:
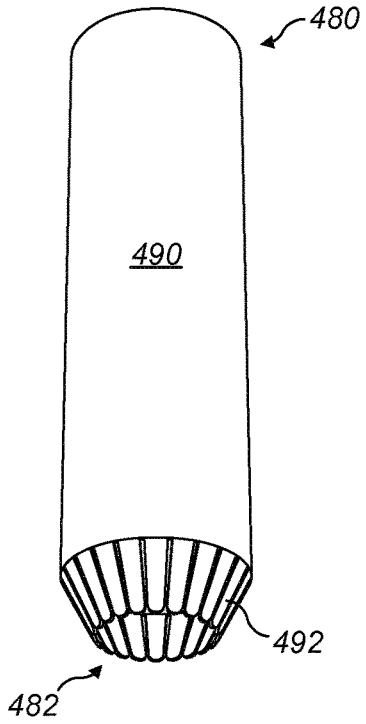
FIG. 15 shows a perspective view of an elongate cleaning tool formed from the removable laminar blank of FIG. 14.

Referring to FIG. 15, the resulting elongate cleaning tool 480 according to the fourth embodiment is tubular and has a circular cylindrical shape. As with the third embodiment, the elongate cleaning tool 480 has a plurality of bristles 492 at its distal end which are formed by folding each of the discrete fingers 470 of the removable laminar blank 450 along their respective transverse fold line 472 towards the central passage, or lumen, of the tool 480. The bristles 492 form part of the scraping surface 482 of the tool 480.

Figure 16A:
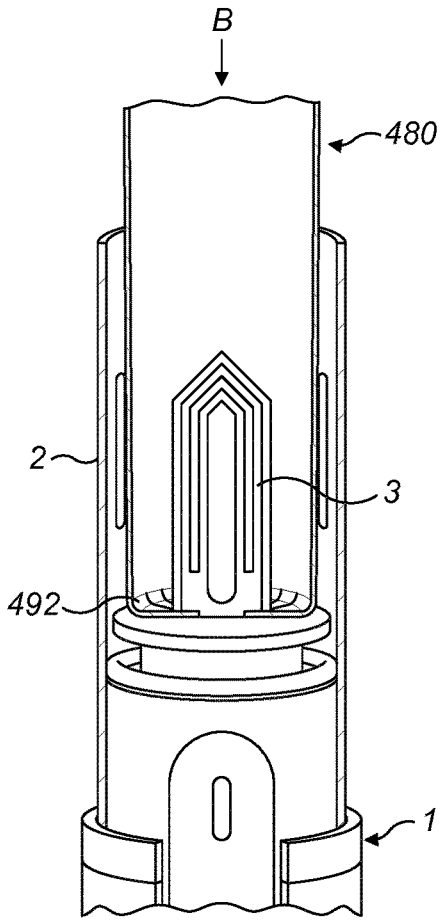
FIG. 16A shows a partial cut-away side perspective view of the elongate cleaning tool of FIG. 15 in use in the cavity of an aerosol-generating device.
Figure 16B:
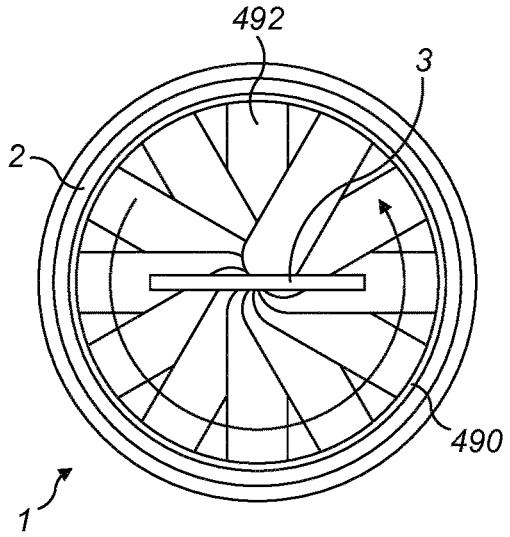
FIG. 16B shows an end view in the direction of arrow B in FIG. 16A.

FIGS. 16A and 16B show the elongate cleaning tool 480 in use in the cavity 2 of an aerosol-generating device 1. The tubular cross-sectional shape of the elongate cleaning tool 480 allows the heater blade 3 in the cavity 2 to be accommodated in the central passage 486 of the tool 480. The heater blade 3 and the cavity 2 may then be mechanically cleaned with the scraping surface 482 and bristles 490 by moving the cleaning tool 480 around within the cavity 2. Advantageously, the bristles 490 provide an additional cleaning surface to facilitate mechanical cleaning of the cavity 2 and the heater 3, particularly in regions which might be otherwise hard to reach with a tool without any transversely extending portions. The bristles 490 are pointed towards, and flex around, the internal heater blade 3 during cleaning to accommodate the heater blade 3 and increase the level of contact between the tool 480 and the heater blade 3. The bristles 490 may also allow for a greater scraping force to be applied to the heater blade 3 in a transverse direction. Once the cavity 2 has been cleaned, the elongate cleaning tool 480 is withdrawn from the cavity 2 and the aerosol-generating device 1 is then inverted to allow dislodged debris to fall out of the cavity 2. The aerosol-generating device 1 may then be used again as normal.

The specific embodiments and examples described above illustrate but do not limit the invention. It is to be understood that other embodiments of the invention may be made and the specific embodiments and examples described herein are not exhaustive.

The invention claimed is:

1. A container for aerosol-generating articles, the container comprising:

a box portion formed from a single laminar blank;

a lid portion formed from a same single laminar blank as the box portion;

a plurality of aerosol-generating articles disposed within the box portion; and a removable laminar blank made from a same material as the single laminar blank, the removable laminar blank being disposed within and attached to the lid portion, wherein the removable laminar blank comprises at least one longitudinal line of weakness, the removable laminar blank being foldable along the at least one longitudinal line of weakness to form an elongate cleaning tool having a scraping surface at a distal end thereof, wherein the at least one longitudinal line of weakness comprises a plurality of longitudinal lines of weakness each extending along substantially an entire length of the removable laminar blank and disposed such that, when the removable laminar blank is folded along the plurality of longitudinal lines of weakness to form the elongate cleaning tool, the elongate cleaning tool has a closed cross-sectional shape, and wherein the plurality of longitudinal lines of weakness are disposed such that longitudinal side edges of the removable laminar blank overlap with each other when the removable laminar blank is folded along the plurality of longitudinal lines of weakness to form the elongate cleaning tool.

2. The container according to claim 1, wherein the distal end has a diameter of less than or equal to a diameter of at least one of the aerosol-generating articles.

3. The container according to claim 1, wherein the removable laminar blank is integral with the single laminar blank and is attached to the single laminar blank by a line of weakness.

4. The container according to claim 3, wherein the lid portion comprises:

a lid portion back wall depending from a box portion back wall;

a lid portion top wall depending from the lid portion back wall; and a lid portion front wall depending from the lid portion top wall, wherein the lid portion front wall comprises a lid portion front panel depending from the lid portion top wall, and a lid portion front wall under panel depending from the lid portion front panel, wherein the lid portion front wall under panel underlies the lid portion front panel, and wherein the removable laminar blank is at least partially defined by the lid portion front wall under panel.

5. The container according to claim 4, wherein the lid portion further comprises an additional lid portion under panel depending from the lid portion front wall under panel, and wherein the removable laminar blank is at least partially defined by the lid portion under panel.

6. The container according to claim 1, wherein the at least one longitudinal line of weakness or longitudinal side edges of the removable laminar blank, or both the at least one longitudinal line of weakness and the longitudinal side edges of the removable laminar blank, are non-parallel to a longitudinal axis of the removable laminar blank such that, when the removable laminar blank is folded along the at least one longitudinal line of weakness to form the elongate cleaning tool, the elongate cleaning tool tapers towards the scraping surface.

7. The container according to claim 1, wherein the plurality of longitudinal lines of weakness are disposed such that, when the removable laminar blank is folded along the plurality of longitudinal lines of weakness to form the elongate cleaning tool, the elongate cleaning tool has a triangular cross-sectional shape.

8. The container according to claim 1, wherein the removable laminar blank further comprises at least one proximal line of weakness at or adjacent to a proximal end of the removable laminar blank and extending along only part of a length of the removable laminar blank, the removable laminar blank being foldable along the at least one proximal line of weakness to form a handle portion extending outwardly from the elongate cleaning tool at or adjacent to the proximal end of the elongate cleaning tool.

9. The container according to claim 1, wherein the at least one longitudinal line of weakness is formed by creasing, scoring, ablation, or any combination thereof.

10. The container according to claim 1, wherein the removable laminar blank comprises a plurality of discrete fingers at a distal end thereof, each discrete finger of the plurality of discrete fingers being foldable along a transverse fold line to form inwardly extending bristles defining the scraping surface at the distal end of the elongate cleaning tool.

11. A container for aerosol-generating articles, the container comprising:

a box portion formed from a single laminar blank;

a lid portion formed from a same single laminar blank as the box portion;

a plurality of aerosol-generating articles disposed within the box portion; and a removable laminar blank made from a same material as the single laminar blank, the removable laminar blank being disposed within and attached to the lid portion, wherein the removable laminar blank comprises at least one longitudinal line of weakness, the removable laminar blank being foldable along the at least one longitudinal line of weakness to form an elongate cleaning tool having a scraping surface at a distal end thereof, wherein the at least one longitudinal line of weakness comprises a plurality of longitudinal lines of weakness each extending along substantially an entire length of the removable laminar blank and disposed such that, when the removable laminar blank is folded along the plurality of longitudinal lines of weakness to form the elongate cleaning tool, the elongate cleaning tool has a closed cross-sectional shape, and wherein the removable laminar blank further comprises at least one additional longitudinal line of weakness disposed such that, when the removable laminar blank is folded along the plurality of longitudinal lines of weakness in a first direction and is folded along the at least one additional longitudinal line of weakness in a second, opposite, direction to form the cleaning tool, the elongate cleaning tool comprises an internal projection extending into a central lumen of the elongate cleaning tool, the at least one additional longitudinal line of weakness forming a vertex of the internal projection.

12. A container for aerosol-generating articles, the container comprising:

a box portion;

a lid portion;

a plurality of aerosol-generating articles disposed within the box portion; and a removable laminar blank initially disposed in the box portion, or the lid portion, or both, wherein the removable laminar blank is foldable about longitudinal lines of weakness each extending along a longitudinal axis of the removable laminar blank, from a first position when disposed in the box portion to a second position when disposed outside of the box portion, to form a tubular elongate cleaning tool, and wherein the longitudinal lines of weakness are disposed such that, when the removable laminar blank is folded along the longitudinal lines of weakness into the second position, the elongate cleaning tool has a triangular cross-sectional shape and a maximum dimension in a transverse direction to the longitudinal axis of less than a diameter of at least one of the aerosol-generating articles disposed within the box portion.

13. The container according to claim 12, wherein the removable laminar blank comprises a plurality of discrete fingers at a distal end thereof, each discrete finger of the plurality of discrete fingers being foldable along a transverse fold line to form inwardly extending bristles defining a scraping surface at the distal end of the elongate cleaning tool.

14. The container according to claim 12, wherein the elongate cleaning tool comprises a central lumen and one or more internal projections extending into the central lumen.

* * * * *